United States Patent [19]

Hayashi

[11] Patent Number: 4,872,541

[45] Date of Patent: Oct. 10, 1989

[54] VENDING MACHINE HAVING SLAVE DISPENSING UNITS

[75] Inventor: Yukichi Hayashi, Sakada, Japan

[73] Assignee: Kabushiki Kaisha Nippon Coinco, Tokyo, Japan

[21] Appl. No.: 323,041

[22] Filed: Mar. 10, 1989

Related U.S. Application Data

[63] Continuation of Ser. No. 734,661, May 15, 1985, abandoned.

[30] Foreign Application Priority Data

May 27, 1984 [JP] Japan ..... 59-106730

[51] Int. Cl.[4] ..... G07F 5/22

[52] U.S. Cl. ..... 194/217; 221/129; 364/479

[58] Field of Search ..... 194/217, 218, 350; 221/2, 5, 6, 8, 129; 364/479

[56] References Cited

U.S. PATENT DOCUMENTS

Re. 31,162 3/1983 Bachmann et al. ..... 221/131 X
4,247,899 1/1981 Schiller et al. ..... 364/479 X
4,499,985 2/1985 Schuller ..... 194/218 X
4,526,263 7/1985 Levasseur ..... 221/5 X

FOREIGN PATENT DOCUMENTS 57-27511 6/1982 Japan .

*Primary Examiner*—F. J. Bartuska
*Attorney, Agent, or Firm*—Spensley Horn Jubas & Lubitz

[57] ABSTRACT

This vending machine system comprises a single master vendor including a coin mechanism and a vend possible judgement circuit and a plurality of slave vendors controlled by this master vendor. The master vendor comprises a master control unit for controlling the operation of the respective slave vendors. Each of the slave vendors comprises a subcontrol unit which performs transmission and receiving of information relative to the master control unit and controls the article vending operation in response to the information provided from the master control unit. The transmission and receiving of the information between the subcontrol units and the master control unit is exclusively performed in accordance with a request issued from the side of the master control unit.

13 Claims, 18 Drawing Sheets

VENDING MACHINE HAVING SLAVE DISPENSING UNITS

BACKGROUND OF THE INVENTION

This invention relates to a vending machine in which a plurality of separate slave vendor units are connected addibly or detachably to a master vendor.

Since the number of article conveying columns in a vending machine is physically fixed, an extra vending machine must be additionally provided if the kind of articles to be handled by the vending machine is to be increased. Each vending machine, however, has a coin mechanism, a vend possible judgment device, an article selection device and an article conveying device and, if the article conveying device is to be increased, the coin mechanisms, vend possible judgement devices and control devices related thereto are necessarily provided by the number of the vending machine increased notwithstanding the fact that the article selection devices and the article conveying devices only need to be increased. Such superfluous provision of the coin mechanism etc. results in waste of the manufacturing cost and therefore is quite uneconomical.

For overcoming such defect, there has recently been proposed what may be called a master-and-subunit vending machine. According to this proposal, a master vendor having independent functions of a vending machine is provided and one or more subunit vendors having only the article selection and conveying functions and having no coin mechanism are connected to the master vendor. An example of such master-and-subunit vending machine is disclosed in Japanese Patent Publication No. 57-27511. Judging from the construction of the article conveying control circuit of the proposed vending machine, the article conveying control circuit to be included in a single vending machine is simply divided into several control circuits corresponding to several article selection switches and each of the divided control circuits is disposed in each subunit vendor as the article conveying control circuit for the subunit vendor and these subunit vendors are connected to the master vendor by electrical wiring. While an article conveying operation is performed in one subunit vendor, connection between all other subunit vendors and the master vendor is cut off and the respective subunit vendors are incapable of operating independently from one another.

It is, therefore, an object of the invention to provide a vending machine comprising a master vendor having at least a coin mechanism and vend possible judgement means and one or more separate slave vendors having no coin mechanism combined to the master vendor characterized in that the respective slave vendors are capable of operating as independently from one another as possible.

In view of the fact that the prior art vending machine in which plural vendor units are connected to a master vendor necessitates a large number of wiring for connection, it is another object of the invention to simplify the connection wiring by improving an information transmission and receiving system between the master vendor and the slave vendors.

SUMMARY OF THE INVENTION

Referring to FIG. 1 which shows the basic concept of the vending machine according to the invention, the vending machine comprises a master vendor 1 including at least a coin mechanism 2 for performing receiving and paying out of money and vend possible judgement means 3, a plurality of article stockers 4, article selection means 5 corresponding to the respective article stockers and one or more slave vendors $7_1$–$7_n$ each including an article conveying device 6 for dispensing an article from the respective article stockers. The master vendor 1 and the respective slave vendors $7_1$–$7_n$ consist of separate units and one or more vendors $7_1$–$7_n$ having a desired vending function can be connected to a single master vendor 1 as desired.

The master vendor 1 includes master control unit MCU for controlling the operation of the respective vendors $7_1$–$7_n$. The vendors $7_1$–$7_n$ include subcontrol units $SCU_1$–$SCU_n$ which supply necessary information to the master control unit MCU and also receive the control information from the master control unit MCU to control the operations of the respective devices provided in the vendors $7_1$–$7_n$.

Transmission and receiving of information between the master vendor 1 and the respective vendors $7_1$–$7_n$ are effected between the master control unit MCU and the subcontrol units $SCU_1$–$SCU_n$. The invention is characterized in that transmitting of certain information from a specific one of the subcontrol units $SCU_1$–$SCU_n$ to the master control unit MCU (since this mode is receiving as viewed from the master control unit MCU, this will be referred to as "receiving mode" in the embodiment to be described hereinbelow) and receiving of certain information by a specific one of the subcontrol units $SCU_1$–$SCU_n$ from the master control unit MCU (since this mode is transmission as viewed from the master control unit MCU, this will be referred to as "transmission mode" hereinafter) are demanded exclusively from the side of the master control unit MCU and the respective subcontrol units $SCU_1$–$SCU_n$ transmit and receive the information in accordance with the demands of this master control unit MCU.

According to the invention, the transmission and receiving of information between the respective subcontrol units and the master control unit are controlled under the leadership of the master control unit and the operations of the respective vendors are controlled in response to this control. Accordingly, operation timing and other operation factors can be properly controlled by the master control unit so that the respective vendors can be controlled as if they were connected independently to the master vendor.

In addition, necessary information only can be transmitted and received in accordance with the demands of the master control unit, the amount of information to be transmitted and received at a time between the master control unit and the respective subcontrol units can be reduced with resulting decrease in the number of wirings necessary for transmission of information.

BRIEF DESCRIPTION OF THE DRAWINGS

In the accompanying drawings,

FIGS. 16 through 19 are time charts showing respectively states f signals at input and output ports of the subcontrol units in a case where request signal wiring has been increased as shown in the examples of FIGS. 8, 9 and 13 in which FIG. 16 shows a case where a given unit number is the number of the subcontrol unit, FIG. 17 a case where the given unit number is not the number of the subcontrol unit, FIG. 18 a case where the time length of the request signal is shortened as compared with the example of FIG. 16 and FIG. 19 a case where the request signal has not been given at all.

DESCRIPTION OF PREFERRED EMBODIMENTS

An embodiment of the invention will now be described with reference to the accompanying drawings.

Hardware construction

Figure 1:
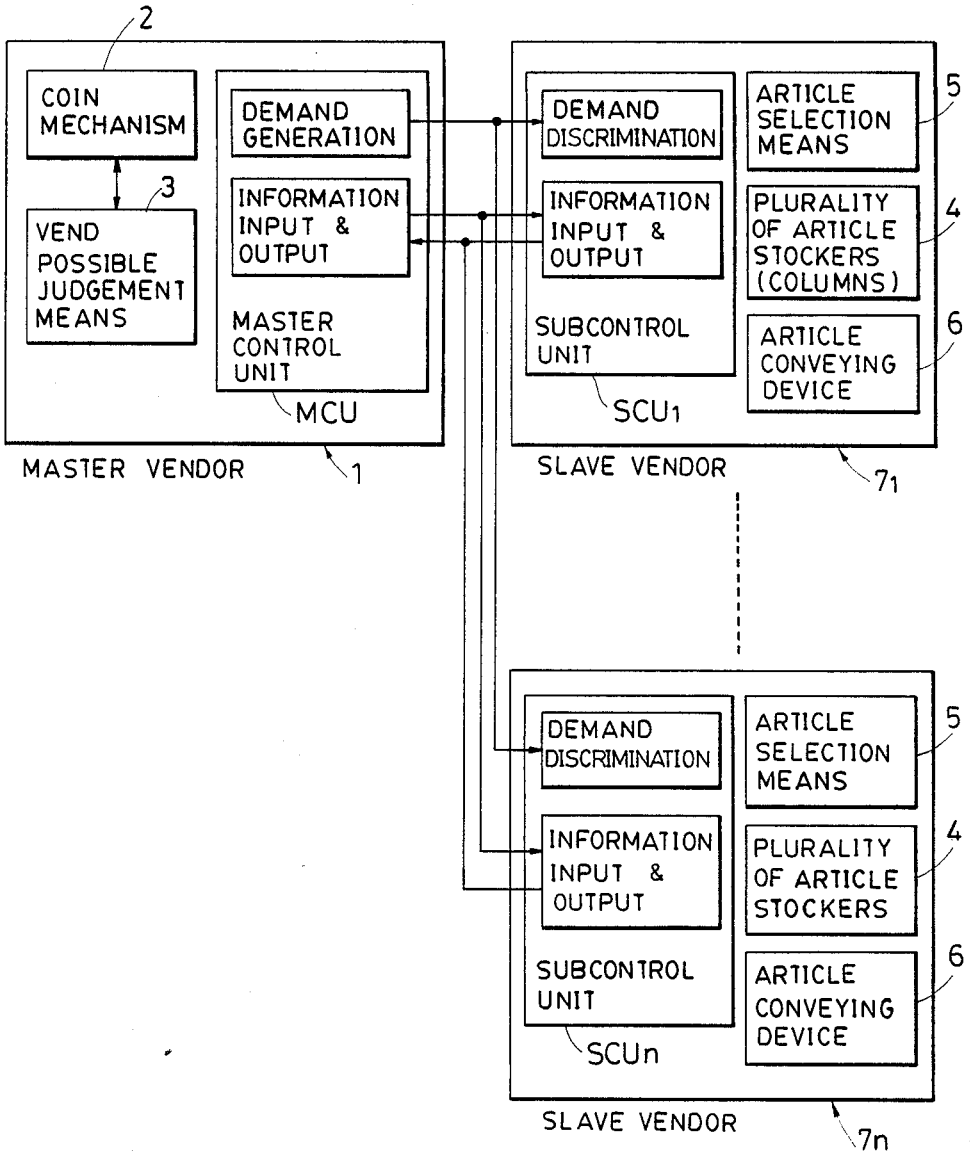
FIG. 1 is a block diagram showing the basic concept of the vending machine of the invention.
Figure 2:
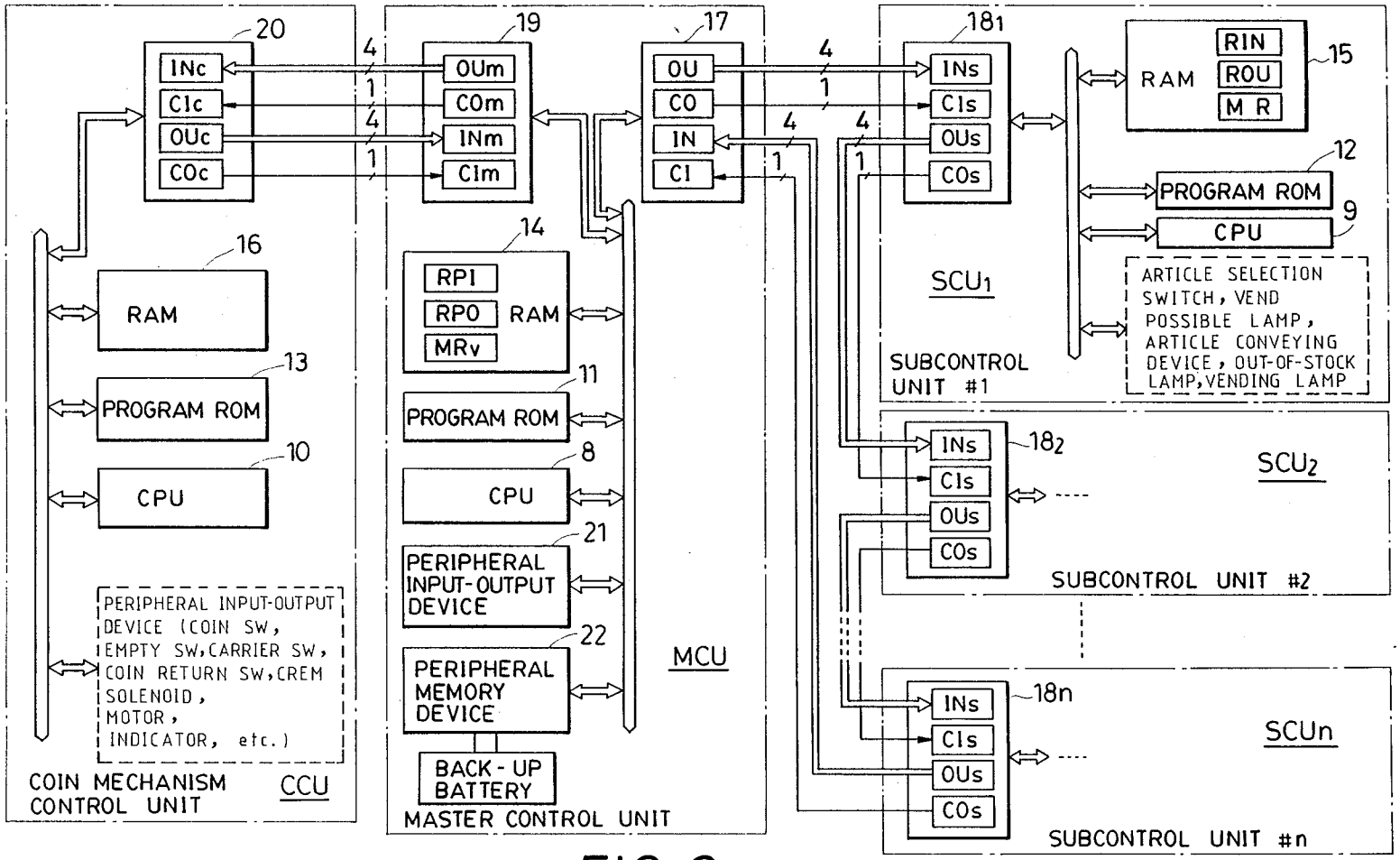
FIG. 2 is a block diagram showing the hardware construction of an embodiment of the vending machine of the invention.

Referrring to FIG. 2, a coin mechanism control unit CCU is a control device for the coin mechanism 2 (FIG. 1) and performs computation and control relating to receiving and paying out of money and a function corresponding to vend possible judgement means 3 (FIG. 1). The master control unit MCU and plural subcontrol units $SCU_1$–$SCU_n$ perform the functions described above in conjunction with FIG. 1.

By way of example, the respective control units MCU, $SCU_1$–$SCU_n$ and CCU are composed of microcomputer systems, having central processing units (hereinafter referred to as CPU) 8, 9 and 10, program ROMs (ROM being an abbreviation of read-only memory) 11, 12 and 13, random-access memories (hereinafter referred to as RAM) 14, 15 and 16 and input-output port sections (hereinafter referred to as I/O port sections) 17, $18_1$–$18_n$, 19 and 20.

Peripheral input-output devices such as coin switches for respective denominations, empty switches for respective denominations, a coin payout motor, a carrier switch for this motor, a coin return switch, a CREM solenoid and a money amount indicator are connected to a busline of the coin mechanism control unit CCU and controlled by the control unit CCU.

The master control unit MCU has attachments such as peripheral input-output device 21 comprising a data setting keyboard for setting various data including a set vend price and a display relating thereto and a peripheral memory device 22 for storing sales data, set vend price and other various set data.

Setting and storing of vend prices for the respective vendors $7_1$–$7_n$ (FIG. 1) are performed by this master control unit MCU.

To the respective subcontrol units $SCU_1$–$SCU_n$ are connected a group of article selection switches, a vend possible lamp, an article conveying device, an out-of-stock lamp, a vending lamp and other devices provided on the respective corresponding vendors $7_1$–$7_n$.

For transmitting and receiving necessary information between the master control unit MCU and the subcontrol units $SCU_1$–$SCU_n$ and controlling the subcontrol units $SCU_1$–$SCU_n$, the I/O port section 17 of MCU and the I/O port sections $18_1$–$18_n$ of the respective $SCU_1$–$SCU_n$ are detachably connected to each other by means of connectors and wirings not shown. Various manners of connection wirings are conceivable as will be described later. By way of example, as shown in FIG. 2, an OU port (data output port) and a CO port (control signal output port) of the master control unit MCU are connected to an $IN_s$ port (data input port) and a $CI_s$ port (control signal input port) of the first subcontrol unit $SCU_1$ and an $OU_s$ port (data output port) and a $CO_s$ port (control signal output port) of the subcontrol unit $SCU_1$ are connected to the $IN_s$ port and the $CI_s$ port of the second subcontrol unit $SCU_2$Likewise, the output ports $OU_s$ and $CO_s$ of each subsequent subcontrol unit are connected to the input ports $IN_s$ and $CI_s$ of the adjacent subcontrol unit and the output ports $OU_s$ and $CO_s$ of the last subcontrol unit $SCU_n$ are connected to a data input port IN and a control signal input port CI of the master control unit. Such sequential and serial connection can save a large amount of wiring as compared to a case where the output of the master control unit MCU is distributed to the respective subcontrol units $SCU_1$–$SCU_n$ in parallel and the outputs of the respective subcontrol units $SCU_1$–$SCU_n$ are applied to the master control unit MCU in parallel. As will be described later, control is effected in such serial connection such that number data representing a subcontrol unit which is to receive or has transmitted information is transmitted and received with the information to be transmitted and received. Each subcontrol unit judges whether the number data received at the data input port $IN_s$ is its number or not and, if it is not its number, the number data is immediately delivered out of the data output port $OU_s$.

The master control unit MCU has a function of controlling the coin mechanism control unit CCU in addition to the function of controlling the respective subcontrol units $SCU_1$–$SCU_n$. In this function also, the receiving of information by the coin mechanism control unit CCU from the master control unit MCU or, conversely, transmission of information from CCU to MCU is demanded from the side of the master control unit MCU as in the function of the master control unit MCU with respect to the subcontrol units $SCU_1$–$SCU_n$. Since this mechanism is described in detail in the specification of Japanese Patent Application No. 29129/1983 and is not a part of the subject matter of the present invention, detailed description thereof will be omitted.

The master control unit MCU has another I/O port section 19 for connection with the coin mechanism control unit CCU. The connection of the I/O port section 19 of MCU and an I/O port section 20 of CCU is effected as illustrated in the figure, i.e., output ports $OU_m$, $OU_c$, $CO_m$ and $CO_c$ of one side are connected to input ports $IN_m$, $IN_c$, $CI_m$ and $CI_c$ of the other side.

Data transmitted and received through the I/O port sections 17–20 consists of four bits per one word and control signals transmitted and received through the I/O port sections 17–20 consists of one bit. The control signals transmitted and received through the control signal input-output ports are used for ensuring the transmission and receiving operations of the data transmitted and received through the data input-output ports.

Description will now be made briefly about registers and memories related to the I/O port sections 17 and 18$_1$–18$_n$. Input port data registers RIN and RPI temporarily store data received from the data input ports IN$_s$ and IN. Output port data registers ROU and RPO temporarily store data to be transmitted from data output ports OU$_s$ and OU. Data pool memories MR and MR$_v$ temporarily store (pool) a set of data for one mode received through the data input ports IN$_s$ and IN and the registers RIN and RPI or a set of data to be transmitted through the data output ports OU$_s$ and OU and the registers ROU and RPO. Predetermined areas in the RAMs 14 and 15 are utilized. Similar registers and memories are provided for the I/O port sections 19 and 20 of which detailed description will be omitted.

Description of data

A specific example of data transmitted and received between the master control unit MCU and the respective subcontrol units SCU$_1$–SCU$_n$ through the data input-output ports OU, IN$_s$, OU$_s$ and IN will now be described.

(1) Data transmission format

One unit of information to be transmitted and received consists of data of plural words arranged in the order as shown in Table 1, one word being 4-bit parallel data. In Table 1, the unit numbers and module codes of Order 1 and Order 2 are always transmitted from the side of the master control unit MCU whereas signals of Orders 3 to 2+n are transmitted from the side of the subcontrol units in the case of the receiving mode and transmitted from the side of the master control unit in the case of the transmission mode.

TABLE 1

| order | 1 | 2 | 3 to 2+ n | end |
|---|---|---|---|---|
| | number of words | | | |
| bit | 1 | 1 | n | |
| 0 | | | | 0 |
| 1 | unit | module | contents of signal | 0 |
| 2 | number | code | to be transmitted | 0 |
| 3 | | | and received | 0 |

In Table 1, "unit number" means data representing the number identifying one of the subcontrol units SCU$_1$–SCU$_n$ (i.e., vendors 7$_1$–7$_n$) to recieve or transmit information.

"Module code" means a code representing transmission and receiving mode of information and a demand as to which information is to be transmitted or received is indicated by this module code.

"Contents of signal to be transmitted and received" means that data representing specific contents of the information indicated by the module code has been assigned here and being transmitted and received.

The signal "0000" which is finally transmitted is an end code indicating the end of transmission of information of one unit. The logical expression of the bit signals is active-low, i.e., "0" being an active level (signal present) and "1" being a non-active level (signal absent). In Table 1, the bits 0, 1, 2 and 3 indicate respective bits of the 4-bit data constituting one word, 0 indicating LSB and 3 indicating MSB.

(2) Data contents of the unit number

Table 2 shows data contents of the "unit number" consisting of four bits.

TABLE 2

| | data (bit) | | | | | data (bit) | | | |
|---|---|---|---|---|---|---|---|---|---|
| number | 3 | 2 | 1 | 0 | number | 3 | 2 | 1 | 0 |
| no number | 1 | 1 | 1 | 1 | 8 | 0 | 1 | 1 | 1 |
| 1 | 1 | 1 | 1 | 0 | 9 | 0 | 1 | 1 | 0 |
| 2 | 1 | 1 | 0 | 1 | A | 0 | 1 | 0 | 1 |
| 3 | 1 | 1 | 0 | 0 | B | 0 | 1 | 0 | 0 |
| 4 | 1 | 0 | 1 | 1 | C | 0 | 0 | 1 | 1 |
| 5 | 1 | 0 | 1 | 0 | D | 0 | 0 | 1 | 0 |
| 6 | 1 | 0 | 0 | 1 | E | 0 | 0 | 0 | 1 |
| 7 | 1 | 0 | 0 | 0 | F | 0 | 0 | 0 | 0 |

(3) Contents of the module code

Sixteen types of different modes can be expressed by the module code of four bits. By way of example, the following six modes can be set in correspondence to decimal values of the code "1", "2", "3", "8", "9" and "10". The respective modes are generally classified into the receiving mode and the transmission mode. The receiving mode is one in which the master control unit MCU receives information from the subcontrol units SCU$_1$–SCU$_n$ and the transmission mode is one in which the master control unit MCU transmits information to the subcontrol units. In the case of the receiving mode, the unit numbers and the module codes of the Orders 1 and 2 in Table 1 are transmitted from the side of the master control unit MCU and, in response thereto, the signal of the Orders 3 to 2+n of Table 1 are transmitted from one of the subcontrol units.

TABLE 3

| Receiving mode | | | | | | |
|---|---|---|---|---|---|---|
| data (bit) | | | | | | number |
| 3 | 2 | 1 | 0 | Symbol | mode name | of words |
| 1 | 1 | 1 | 0 | SVMC1 | master control unit indication mode | 3 words |
| 1 | 1 | 0 | 1 | SVMC2 | sold-out contents indication mode | 6 words |
| 1 | 1 | 0 | 0 | SVMC3 | conveying possible column indication mode | 6 words |

TABLE 4

| Transmission mode | | | | | | |
|---|---|---|---|---|---|---|
| data (bit) | | | | | | number |
| 3 | 2 | 1 | 0 | Symbol | mode name | of words |
| 0 | 1 | 1 | 1 | SVMC8 | subcontrol unit indication mode | 3 words |
| 0 | 1 | 1 | 0 | SVMC9 | vend possible lamp lighting indication mode | 6 words |
| 0 | 1 | 0 | 1 | SVMC10 | sold-out lamp lighting indication mode | 6 words |

In the above Tables 3 and 4, symbols indicate symbols of code contents corresponding to the respective code names and the number of words indicates one of a signal to be transmitted and received in the corresponding module code (i.e., n in Table 1).

"Master control unit indication mode" (module code SVMC1) is a mode in which various operation modes in the subcontrol units SCU$_1$–SCU$_n$ are notified to the master control unit MCU.

"Sold-out contents indication mode" (module code SVMC2) is a mode in which whether or not an article is out of stock in each article stocker (hereinafter called "column") of the subcontrol units SCU$_1$–SCU$_n$ is notified to the master control unit MCU.

"Conveying possible column indication mode" (module code SVMC3) is a mode in which a column capable of conveying an article is notified from the side of the subcontrol units $SCU_1$–$SCU_n$ to the master control unit MCU.

"Subcontrol unit indication mode" (module code SVMC8) is a mode in which various operation orders and other necessary information are supplied from the master control unit MCU to the subcontrol units $SCU_1$–$SCU_n$.

"Vend possible lamp lighting indication mode" (module code SVMC9) is a mode in which information for lighting a vend possible lamp in correspondence to a column which has been judged to be capable of vending from the master control unit MCU to the subcontrol units $SCU_1$–$SCU_n$ "Sold-out lamp lighting indication mode" (module SVMC10) is a mode in which information for lighting a sold-out lamp in correspondence to a column in which the article has been sold out is supplied from the master control unit MCU to the subcontrol units $SCU_1$–$SCU_n$.

(4) Contents of signals transmitted and received in respective modes

Formats of signals each consisting of three words which are transmitted and received in "master control unit indication mode" (module code SVMC1) or "subcontrol unit indication mode" (module code SVMC8) are described in the following Table 5. In the word order 1, data representing the name of signal to be transmitted and received (i.e., type of information to be transmitted and received) is transmitted and received and in the word orders 2 and 3, data representing the column number is transmitted and received. In the word order 2, data of the order of 1 ($10^0$) of the column number is transmitted and received and in the word order 3, data of the order of 10 ($10^1$) is transmitted and received.

TABLE 5

| bit | word order 1 | 2 | 3 |
|---|---|---|---|
| 0 | | | |
| 1 | name of | column | column |
| 2 | signal | number | number |
| 3 | | ($10^0$) | ($10^1$) |

The name of a signal which is transmitted and received in "master control unit indication mode" (module code SVMC1) is one of those listed in Table 6. Each signal in Table 6 consists of data of one word (four bits).

TABLE 6

| Mode of SVMC1 | | | | | |
|---|---|---|---|---|---|
| data (bit) | | | | | |
| 3 | 2 | 1 | 0 | symbol | name of signal |
| 1 | 1 | 1 | 0 | MCN | maximum available column number indication signal |
| 1 | 1 | 0 | 1 | SVB | slave vendor standby signal |
| 1 | 1 | 0 | 0 | SSB | article selection signal input standby signal |
| 1 | 0 | 1 | 1 | SIN | article selection signal input presence indication signal |
| 1 | 0 | 1 | 0 | SHC1 | article conveying signal (1) |
| 1 | 0 | 0 | 1 | SHC2 | article conveying signal (2) |
| 1 | 0 | 0 | 0 | PSO | money collection indication signal |
| 0 | 1 | 1 | 1 | VSHC | vend test article conveying signal |
| 0 | 1 | 1 | 0 | MORK | motor lock signal |
| 0 | 1 | 0 | 1 | HNG1 | conveying malfunctioning (1) |
| 0 | 1 | 0 | 0 | HNG2 | conveying malfunctioning (2) |
| 0 | 0 | 1 | 1 | HNG3 | conveying malfunctioning (3) |
| 0 | 0 | 1 | 0 | HNG4 | conveying malfunctioning (4) |

The maximum available column number indication signal MCN is a signal indicating a maximum number of columns available for use in a particular slave vendor. (i.e., number of article stockers).

The slave vendor standby signal SVB is a signal indicating that the slave vendor is in a standby state (i.e., it is not performing the vending operation).

The article selection signal input standby signal SSB is a signal indicating that an article selection operation in a particular column is in a standby state.

The article selection signal input presence indication signal SIN is a signal indicating that the article selection operation in a particular column has been made.

The article conveying signals (1) and (2) (SHC1 and SHC2) are signals indicating that a particular column is performing the article conveying operation. Difference between SHC1 and SHC2 resides in that SHC1 is used when the article conveying operation can be performed concurrently in one column while the article conveying operation is being performed in another column of the same slave vendor whereas SHC2 is used when such concurrent article conveying operation cannot be performed. By selecting one of these signals SHC1 and SHC2, the master vendor can perform a suitable control no matter which type of the above described mechanisms the slave vendor may adopt.

The money collection indication signal PSO is a signal indicating subtracting of the set vend price of the conveyed article from the amount of deposited money (i.e., money collection operation). This signal is generated in accordance with a column conveying the article at a suitable time point after starting of the article conveying operation.

The vend test article conveying signal VSHC is a signal indicating that an article is being conveyed due to a vend test (an article conveying operation test).

The motor lock signal MORK is a kind of a malfunction code and generated when a conveying motor has been locked (i.e., the carrier switch has kept an ON state) during the article conveying operation.

The conveying malfunctioning signals HNG1–HNG4 are kinds of malfunction codes and generated when malfunctioning has taken place in the article conveying circuit, e.g., malfunction in the relay switches.

The name of a signal which is transmitted and received in the "subcontrol unit indication mode" (module code SVMC8) is one of those listed in the following Table 7. In Table 7, each signal consists of data of one word (four bits).

TABLE 7

| Mode of SVMC8 | | | | | |
|---|---|---|---|---|---|
| data (bit) | | | | | |
| 3 | 2 | 1 | 0 | symbol | name of signal |
| 1 | 1 | 1 | 0 | SLFK | vend impossible indication signal |
| 1 | 1 | 0 | 1 | MSTK | master vendor standby signal |
| 1 | 1 | 0 | 0 | CKIC | deposited money presence signal |
| 1 | 0 | 1 | 1 | SLNG | vend impossible signal |
| 1 | 0 | 1 | 0 | SHOK | article conveying indication signal |
| 1 | 0 | 0 | 1 | VTHS | vend test conveying indication signal |
| 1 | 0 | 0 | 0 | NGRS | abnormality reset indication signal |

TABLE 7-continued

| Mode of SVMC8 | | | | | |
|---|---|---|---|---|---|
| data (bit) | | | | | |
| 3 | 2 | 1 | 0 | symbol | name of signal |
| 0 | 1 | 1 | 1 | TMON1 | timer (1) ON indication signal |
| 0 | 1 | 1 | 0 | TMOF1 | timer (1) OFF indication signal |
| 0 | 1 | 0 | 1 | TMON2 | timer (2) ON indication signal |
| 0 | 1 | 0 | 0 | TMOF2 | timer (2) OFF indication signal |
| 0 | 0 | 1 | 1 | TMON3 | timer (3) ON indication signal |
| 0 | 0 | 1 | 0 | TMOF3 | timer (3) OFF indication signal |

The vend impossible signal SLFK is a signal indicating that vending is not possible.

The master vendor standby signal MSTK is a signal indicating that the master vendor is in a standby state.

The deposited money presence signal CKIC is a signal indicating that there is deposited money.

The vend impossible signal SLNG is a signal generated in correspondence to a column in which vending has become impossible.

The article conveying indication signal SHOK is a signal indicating that the article conveying operation should be started.

The vend test conveying indication signal VTHS is a signal indicating start of the article conveying operation during the vend test.

The abnormality reset indication signal NGRS is a signal indicating resetting of a column which has been set at an abnormal state, this signal being provided when the column has recovered from the malfunctioning state.

The three types of timer ON/OFF indication signals TMON1–TMOF3 are signals indicating turning on and off of three types of timers (1), (2) and (3). The master vendor has a time counting function and supplies a timer output to the slave vendors in response to these timer ON/OFF indication signals.

Formats of signals consisting of six words to be transmitted and received in "sold-out contents indication mode" (module code SVMC2) or "conveying possible column indication mode" (module code SVMC3), "vend possible lamp lighting indication mode" (module code SVMC9) or "sold-out lamp lighting indication mode" (module code SVMC10) is described in Table 8. In Table 8, each bit of $6\times4=24$ bits corresponds to one of the column numbers 1–24. The bit of its corresponding column becomes "0" and the bit of not-corresponding column becomes "1".

TABLE 8

| Mode of SVMC2, 3, 9 or 10 | | | | | | |
|---|---|---|---|---|---|---|
| | word order | | | | | |
| bit | 1 | 2 | 3 | 4 | 5 | 6 |
| 0 | column 1 | column 5 | column 9 | column 13 | column 17 | column 21 |
| 1 | 2 | 6 | 10 | 14 | 18 | 22 |
| 2 | 3 | 7 | 11 | 15 | 19 | 23 |
| 3 | 4 | 8 | 12 | 16 | 20 | 24 |

Description of outline of data transmission and receiving processings

Transmission and receiving of information of one unit in the order as shown in Table 1 between the master control unit MCU and the subcontrol units $SCU_1$–$SCU_n$ are made, by way of example, by proceeding with the order of transmission while confirming word by word, on both the transmitting and receiving sides, that data of the same contents has been received. More specifically, the receiving side returns data which is the same as 4-bit parallel data for one word received to the transmitting side whereas the transmitting side collates the data which it has transmitted with the data which has been returned and proceed to a next data transmitting order upon confirming coincidence of the two data.

Data representing contents of a signal to be transmitted and received which has been transmitted following the module code is sequentially stored in the data pool memory MR or $MR_v$ of the receiving side. When transmission and receiving of an end code has finally been confirmed, contents of the memory MV or $MV_v$ are transferred in a block to a predetermined area in the RAMs 14 and 15 and utilized therein.

Figure 3:
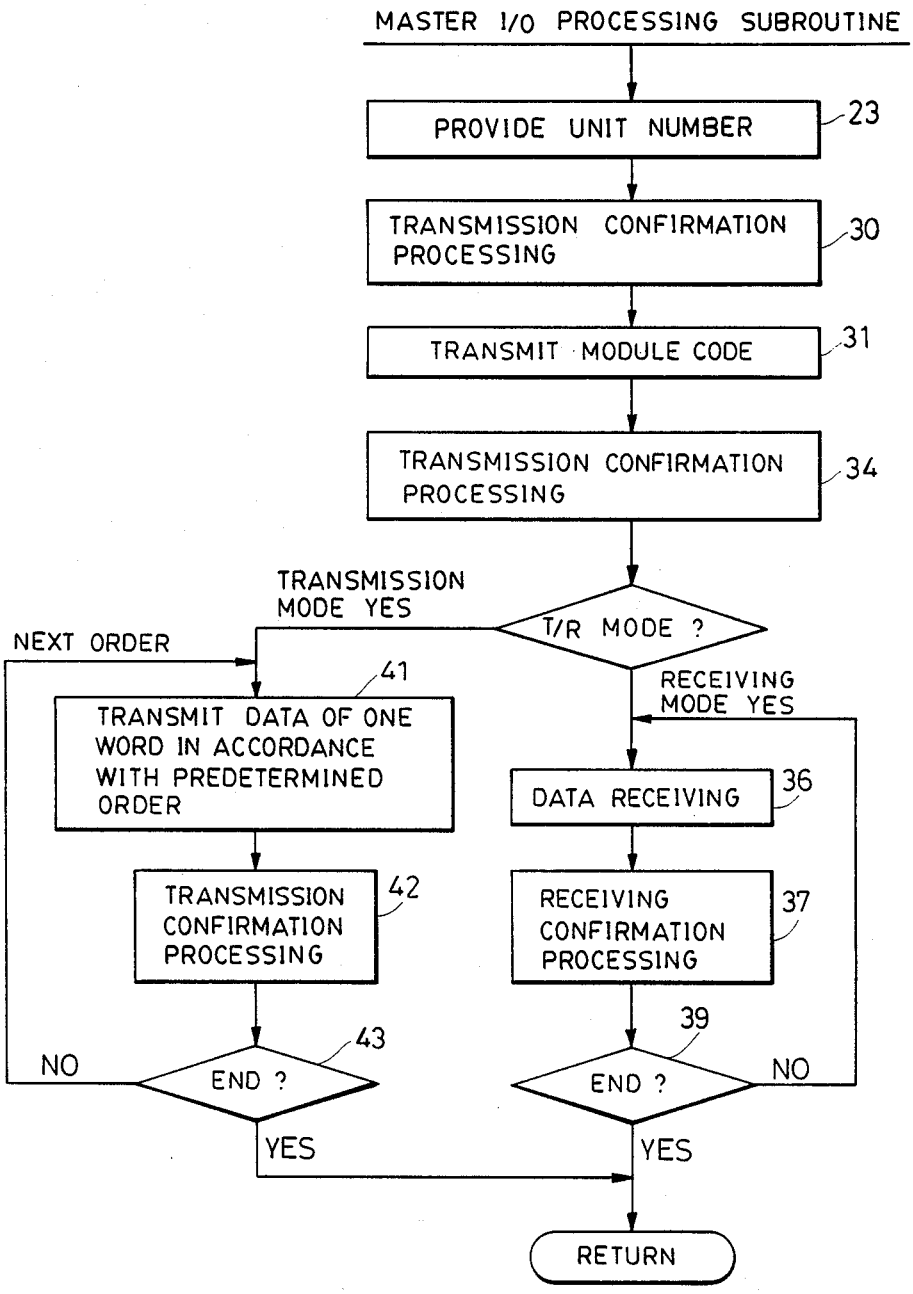
FIG. 3 is a flow chart showing an example of a signal input-output processing subroutine executed on the side of the master control unit in the transmission and receiving of signals between the master control unit and the subcontrol units of the embodiment shown in FIG. 2.
Figure 4:
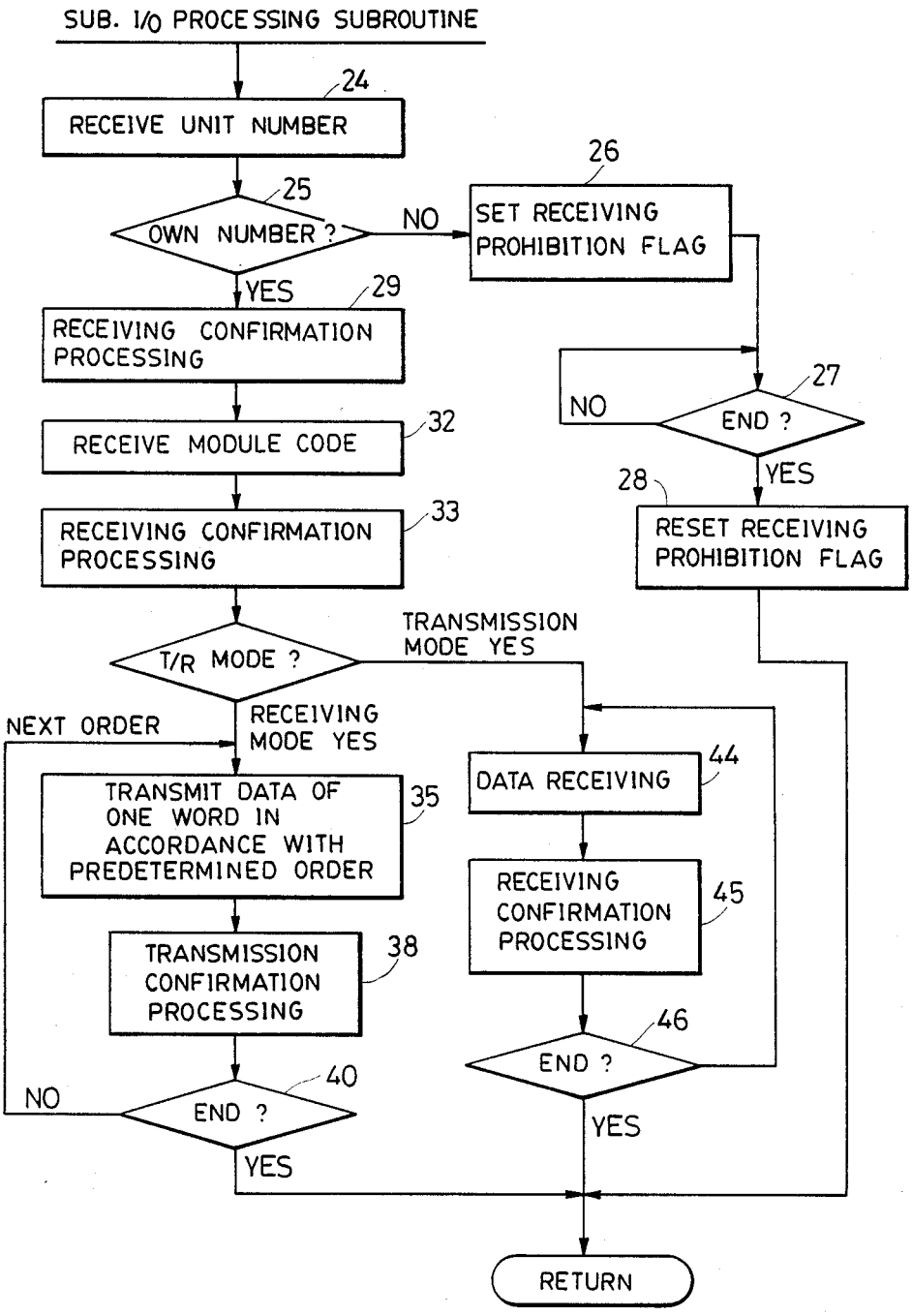
FIG. 4 is a flow chart showing an example of a signal input-output processing subroutine executed on the side the respective subcontrol units in the transmission and receiving of the signals between the master control unit and the subcontrol units of the same embodiment.

FIGS. 3 and 4 schematically show an outline of a program of executing transmission and receiving processing for information of one unit as shown in Table 1. FIG. 3 shows the master I/O subroutine which is executed by the CPU 8 of the master control unit MCU. FIG. 4 shows the sub I/O processing subroutine which is executed by the CPU 9 of the subcontrol units $SCU_1$–$SCU_n$.

By processing of a step 23 of the master I/O processing subroutine, unit number data of a subcontrol unit (one of $SCU_1$–$SCU_n$) which constitutes the object of transmission and receiving of information is provided through the OU port (FIG. 2). The subcontrol units $SCU_1$–$SCU_n$ receive this unit umber data through the $IN_s$ port (FIG. 2) (step 24 in FIG. 4) and judges whether this unit number is its unit number or not (step 25). If the received unit number is not its own unit number, a receiving prohibition flag is set in step 26 thereby prohibiting acceptance of the data received at the $IN_s$ port. In a case where the respective ports are connected in series connection as shown in FIG. 2, if the receiving prohibition flag is set, not only acceptance of data received at the $IN_s$ port is prohibited, but also the signal at the $IN_s$ port is supplied as it is to the $OU_s$ port and transferred to an adjacent subcontrol unit and the control signal at the $CI_s$ port is supplied as it is to the $CO_s$ port and transferred to an adjacent subcontrol unit. By setting of this receiving prohibition flag, a subcontrol unit for which transmission and receiving of information have not been demanded can be interrupted while information of one unit of other subcontrol units is transmitted and received. During setting of the receiving prohibition flag, whether or not the "end code" ("0000") has been given to the $IN_s$ port is constantly checked by processing of step 27. If the result of the checking is YES, this means that transmission and receiving of information of one unit concerning the other subcontrol unit has been completed so that the receiving prohibition flag is reset by step 28 and the processing returns to the original step.

In a case where the given unit number is its own number, the processing proceeds to step 29 in which a receiving confirmation processing is effected. The receiving confirmation processing is a processing in which data which is the same as the 4-bit data received through the $IN_s$ port is returned through the $OU_s$ port At this time, a control signal provided from the $CO_s$ port is set at a predetermined value. At this time, the master control unit is in a state in which it can execute a transmission confirmation processing of step 30 in FIG. 3. The transmission confirmation processing means a processing in which data returned from the $OU_s$ port of the subcontrol unit side (in the subcontrol units other than the one in which the data is transmitted and received, this data passes from the $IN_s$ port to the $OU_s$ port and finally enters the IN port of the master control unit. The control signal of the $CO_s$ port likewise enters the CI port of the master control unit side) is received through the IN port and is compared with the data (the unit number) which was transmitted in the preceding step (i.e., step 23 in the case of step 30). If coincidence has been confirmed as a result of the comparison, the control signal at the CO port is set to a predetermined value and supplied to the $CI_s$ port of the subcontrol unit. In the sole subcontrol unit which has become capable of receiving the data, the change in the control signal at the $CI_s$ port is confirmed in the receiving confirmation processing in the step 29 to confirm that the previously received unit number data has been received correctly and thereupon prepares for receiving a next module code.

In step 31 in the master control unit side, a processing for transmitting a predetermined module code from the OU port is executed. In step 32 in the subcontrol unit side, the module code is received through the $IN_s$ port and then a receiving confirmation processing similar to the previously described one is executed in step 33. Simultaneously, a transmission confirmation processing similar to the previously described one is executed in the master control unit side in step 34.

Upon confirming that the module code has been correctly transmitted and received, a predetermined processing is executed depending upon whether this module code is the transmission mode or the receiving mode.

In the receiving mode, step 35 is executed on the subcontrol unit side in which a signal of contents corresponding to a mode demanded by the module code is provided by one word in the above described predetermined word order through the $OU_s$ port. On the master control unit side at this time, this data is received through the IN port (step 36) and thereafter a receiving confirmation processing is executed in step 37. In step 38 of the subcontrol unit side, a transmission confirmation processing similar to the previously described one is executed. Upon confirmation of the fact that data for one word has been correctly transmitted and received, whether or not the data which has just been transmitted and received is an "end code" is judged in steps 39 and 40. If the result is NO, the processing in the subcontrol unit side returns to step 35 to transmit data of one word of the next transmission order whereas in the master control unit side, the processing returns to step 36. When transmission and receiving of all data have been completed, transmission and receiving being confirmed word by word, steps 39 and 40 become YES, thus completing the transmission and receiving processing of information of one word.

In the case of the transmission mode, the processings on the master control unit side (steps 41, 42 and 43) and those on the subcontrol unit side (steps 44, 45 and 46) are the reverse to those executed in the receiving mode.

Description of data transmission and receiving processing for one word

The basic concept of the data transmission and receiving processing for one word between the master control unit MCU and the subcontrol units $SCU_1$–$SCU_n$ through the I/O port sections 17 and $18_{1-18n}$ is described in the following tables 9 and 10. The data transmission and receiving processing for one word to which this basic concept is applied is the portion including steps 23, 24, 29 and 30 or the portion including steps 31, 32, 33 and 34 or the portion including steps 35, 36, 37 and 38 or the portion including steps 41, 42, 44 and 45 in FIGS. 3 and 4.

According to this basic data transmission and receiving system, a predetermined processing is executed in accordance with a signal state "1" or "0" at the control signal input ports CI and $CI_s$ and the control signal output ports CO and $CO_s$ are set to a predetermined signal state "1" or "0" for demanding the opposite side to perform a next operation. Thus, utilizing the signal states at the control signal input and output ports CI - $CO_s$ as key words, the respective control units MSC and $SCU_1$–$SCU_n$ perform the signal transmission and receiving processing in association with each other, the respective control units being operated by independent programs. Table 9 shows signal conditions at the control signal input and output ports (abbreviated as "C port") in the respective control units during the transmission mode (as viewed from the master control unit MCU) and Table 10 shows similar signal conditions during the receiving mode (as viewed from the master control unit MCU). Contents of processings described in the columns of "input" indicate processings which are executed in response to "1" or "0" at the control signal input ports CI and $CI_s$ and contents of processings described in the columns of "output" indicate processings which are executed when the control signal output ports CO and $CO_s$ have been set to "1" or "0". Since the transmission and receiving of the unit number and the module code are performed upon questioning from the master control unit side, such transmission and receiving are always performed during the transmission mode of Table 9.

TABLE 9

| Signal conditions at C port during the transmission mode | | | | | | | |
|---|---|---|---|---|---|---|---|
| master control unit MCU | | | | subcontrol unit (one of $SCU_1$–$SCU_n$) | | | |
| C port | | contents of processing | order | C port | | contents of processing | order |
| input CI | "1" | Comparision and judgement of signal contents at IN port and OU port are started. | 5 | input $CI_s$ | "1" | Signal at $IN_s$ port is set to RIN register | 3 |
| | "0" | Signal of next time is set to RPO register. | 1 | | "0" | Contents of RIN are stored in MR memory. | 7 |
| output CO | "1" | Contents of RPO are set to OU port and CO port is set to "1". | 2 | output $CO_s$ | "1" | Contents of RIN are set to $OU_s$ port and $CO_s$ port is set to "1". | 4 |
| | "0" | If result of com- | 6 | | "0" | After MR memory | 8 |

TABLE 9-continued

| Signal conditions at C port during the transmission mode | | | | | |
|---|---|---|---|---|---|
| master control unit MCU | | | subcontrol unit (one of $SCU_1$–$SCU_n$) | | |
| C port | contents of processing | order | C port | contents of processing | order |
| | parison is coincidence, CO port is set to "0". | | | processing, $CO_s$ port is set to "0". | |

TABLE 10

| Signal conditions at C port during the receiving mode | | | | | | | |
|---|---|---|---|---|---|---|---|
| master control unit MCU | | | | subcontrol unit (one of $SCU_1$–$SCU_n$) | | | |
| C port | | contents of processing | Order | C port | | contents of processing | Order |
| input CI | "1" | Signal at IN port is set to RPI register. | 3 | input $CI_s$ | "1" | Next signal is set to ROU register. | 1 |
| | "0" | Contents of RPI are stored in $MR_v$ memory. | 7 | | "0" | Comparison and judgement of signal contents at $IN_s$ port and $OU_s$ port are started. | 5 |
| outpout CO | "1" | After $MR_v$ memory processing, CO port is set to "1". | 8 | output $CO_s$ | "1" | Contents of ROU are set to $OU_s$ port and $CO_s$ port is set to "1". | 2 |
| | "0" | Contents of RPI are set to OU port and CO port is set to "0". | 4 | | "0" | If result of comparison is coincidence, $CO_s$ port is set to "0". | 6 |

The number in the columns of order in the above Tables 9 and 10 indicates the order of processing executed between the master control unit MCU and the subcontrol unit $SCU_1$–$SCU_n$. In the transmission mode of the master control unit MCU (Table 9), for example, a signal is transmitted from the master control unit to the subcontrol unit so that the processing for setting a next signal to be transmitted to an output port data register RPO (hereinafter called RPO register) of the master control unit is porcessing of the order number 1. This processing is executed in response to the processing of the order number 8 of the subcontrol unit side. That is, by setting of "0" to the $CO_s$ port of the subcontrol unit by the processing of the order number 8, the control signal applied to the CI port of the master control unit becomes "0" and thereupon the processing of the order number 1 is initiated.

Referring to Table 9, when the control signal applied to the CI port of the master control unit is "0", a signal to be supplied to the subcontrol unit next time (4-bit parallel data) is set at the RPO register (order number 1) and then the contents of RPO register are set at the data output port OU to transmit it to the subcontrol unit and simultaneously set the CO port to "1" (order number 2). The subcontrol unit side receives the 4-bit parallel data signal at an input port register RIN (hereinafter called RIN register) which signal is applied from the OU port to the $IN_s$ port when the control signal supplied from the CO port to the $CI_s$ port has become "1". (order number 3). Nextly, the contents of the RIN register are set at an output port data register ROU (hereinafter called ROU register) and the contents of the ROU register in turn are set at the $OU_s$ port and the $CO_s$ port is set to "1" (order number 4). The contents of the RIN register may be directly provided to the $OU_s$ port, omitting setting of the contents of the RIN register at the ROU register. Thus, the data provided by the master control unit is received by the subcontrol unit and, when this data has been stored in the RIN register, the contents of the RIN register are returned to the master control unit through the $OU_s$ port for the sake of confirmation and a signal "1" is produced by the $CO_s$ port. When the control signal supplied from the $CO_s$ port to the CI port is "1", the master control unit side receives the data provided from the $OU_s$ port to the IN port (i.e., returned for the sake of confirmation) at an input port data register RPI (hereinafter called RPI register) and compares and collates the contents of this data with the contents of the RPO register, i.e., the contents of the OU port (order number 5). If coincidence of the two contents has been confirmed as a result of the comparison, the CO port is set to "0" (order number 6). If the contents of the 4-bit data transmitted from the master control unit (output of the OU port) do not coincide with the 4-bit data received by the subcontrol unit and stored in the RIN register (input at the IN port) due to some transmission error, the CO port is not set to "0" but remains "1". Accordingly, when a transmission error has occurred, the processing does not proceed to a next one so that an erroneous operation of the apparatus by the error data can be prevented. On the subcontrol unit side, when the control signal supplied from the CO port to the $CI_s$ port has been turned to "0", the contents of the RIN register are stored in the data pool memory MR (order number 7). When the contents of the RIN register are returned to the master control unit for collating and have been confirmed to be correct, a signal to be stored in the MR memory is correctly not one supplied to the IN port but one stored in the RIN register. After the storing processing in the MR memory, the $CO_s$ port is set to "0" and the master control unit is demanded to transmit a next signal (order number 8).

One cycle of the processings from the order numbers 1 through in Table 9 is repeated as many times as the number of words of data to be transmitted and received during the transmission mode. Contents of 4-bit data signals to be transmitted in the respective orders of data transmission are as shown in Tables 1, 5 and 8. The data pool memory MR stores sequentially the 4-bit data signals stored in the processing of the order number 7 for each cycle (order) and, when transmission and receiving of the end code have been confirmed, the group of the entire signals for one unit stored in the memory MR (more specifically, data of signals of three words transmitted and received as shown in Table 5 in the case of the SVMC8 mode and, in the case of the SVMC9 mode or the SVMC10 mode, the module code thereof and data of signals of six words transmitted and received as shown in Table 8) is transferred in a block to a certain area in the RAM 15 and stored therein The subcontrol unit performs various processings utilizing the signal group thus transferred in a block and stored in the RAM 15. Accordingly, the signal group can be utilized only when the entire signals for one unit (block) have been correctly transmitted and received so that an erroneous operation caused by the transmission error can be effectively prevented.

The receiving mode shown in Table 10 is processed on the basis of the same concept as in the transmission mode shown in Table 9. Referring to Table 10, when the control signal applied to the $CI_s$ port of the subcontrol unit is "1", a 4-bit parallel data signal to be supplied to the master control unit next time is set at the ROU register (order number 1) and then the contents of ROU register are set at the $OU_s$ port to transmit it to the master control unit and simultaneously set the $CO_s$ port to "1" (order number 2). In the master control unit the 4-bit parallel data provided from $OU_s$ port to IN port are taken in the RPI register when the signal supplied from the $CO_s$ port to the CI port has become "1" (order number 3). Nextly, the contents of the RPI register are set at the RPO register and the contents of the RPO register in turn are set at the OU port and the CO port is set to "0" (order number 4). The contents of the RPI register may be directly provided to the OU port, omitting setting of the contents of the RPI register at the RPO register Thus, the data provided by the subcontrol unit is received by the master control unit and, when this data has been stored in the RPI register, the contents of the RPI register are returned to the subcontrol unit for the sake of confirmation and a signal "0" is produced by the CO port. When the control signal supplied to the $CI_s$ port is "0", the subcontrol unit side receives the data provided from the OU port to the $IN_s$ port at the RPI register and compares and collates the contents of this data with the contents of the ROU register, i.e., the contents of the $OU_s$ port (order number 5). If coincidence of the two contents has been confirmed as a result of the comparison, the $CO_s$ port is set to "0" (order number 6). On the master control unit side, when the control signal supplied from the $CO_s$ port to the CI port has been turned to "0", the contents of the RPI register are stored in the data pool memory $MR_v$ (order number 7). After the storing processing in the $MR_v$ memory, the CO port is set to "1" and the subcontrol unit is demanded to transmit a next signal (order number 8).

One cycle of the processings from the order numbers 1 through 8 in Table 10 is repeated as many times as the number of words of data to be transmitted and received during the receiving mode. Contents of 4-bit data signals to be transmitted in the respective orders of data transmission are as shown in Tables 5 and 8. The data pool memory $MR_v$ stores sequentially the 4-bit data signals stored in the processing of the order number 7 for each cycle (order) and, when transmission and receiving of the end code have been confirmed, the group of the entire signals for one unit stored in the memory $MR_v$ (more specifically, data of signals of three words transmitted and received as shown in Table 5 in the case of the SVMC1 mode and, in the case of the SVMC2 mode or the SVMC3 mode, the module code thereof and data of signals of six words transmitted and received as shown in Table 8) is transferred in a block to a certain area in the RAM 14 and stored therein. The master control unit performs various processings utilizing the signal group thus transferred in a block and stored in the RAM 14.

Description of Outline of the Main Program

The master I/O processing subroutine shown in FIG. 3 is executed as required in various stages in the main processing program in the master control unit MCU. More specifically, this master I/O processing subroutine is executed as required when the master control unit MCU has demanded transmission or receiving of information of a desired mode to a subcontrol unit ($SCU_1$–$SCU_n$) of a desired number in the course of the main program of the master control unit MCU. When and which type of information transmission and receiving mode is demanded is determined by the main program of the master control unit MCU and this can be designed as desired. By way of example, the outline of the main program on the master control unit side is shown in FIG. 5.

Likewise, the sub I/O processing subroutine shown in FIG. 4 is executed as required in various stages of the main processing program in the respective subcontrol units $SCU_1$–$SCU_n$The respective subcontrol units $SCU_1$–$SCU_n$ execute their proper processings relative to peripheral input and output devices (the article selection switch etc.) included in their corresponding slave vendors $7_1$–$7_n$ and thereby prepare for forming of a signal to be transmitted or perform a device control operation responsive to a received signal and, in the meanwhile, execute the sub I/O processing subroutine in a proper stage, performing data transmission and receiving processing relative to the master control unit MCU. The main program in the respective subcontrol units $SCU_1$–$SCU_n$ can be designed as desired depending upon the purpose, function, type etc. of the vending machine. All of the subcontrol units $SCU_1$–$SCU_n$ need not use the same main program but may use different main programs. By way of example, an outline of the main program of the subcontrol unit is shown in FIG. 6.

Figure 5A:
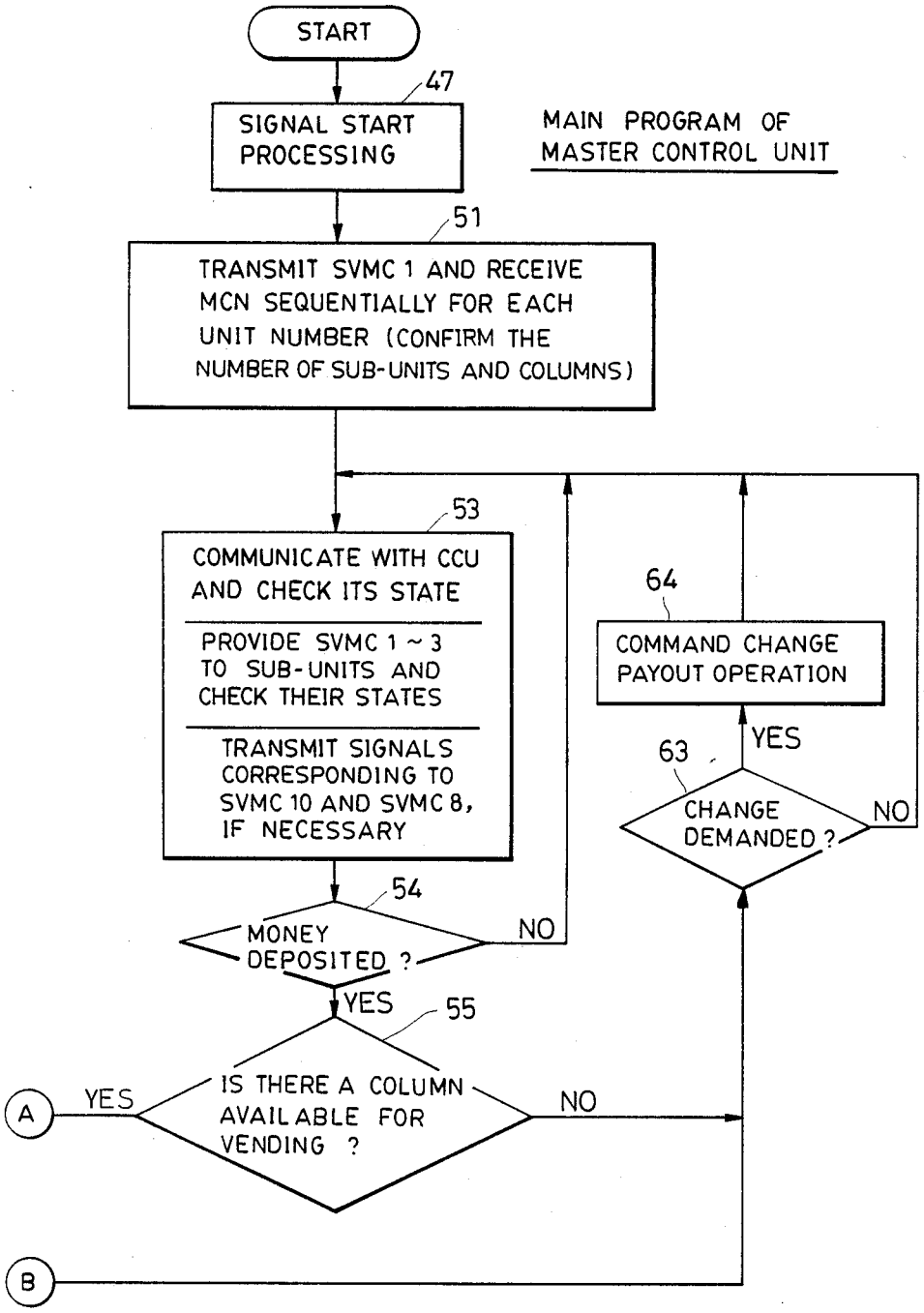
FIGS. 5*a* and 5*b* are flow charts showing schematically an example of a main program executed by the master control unit of the same embodiment.
Figure 5B:
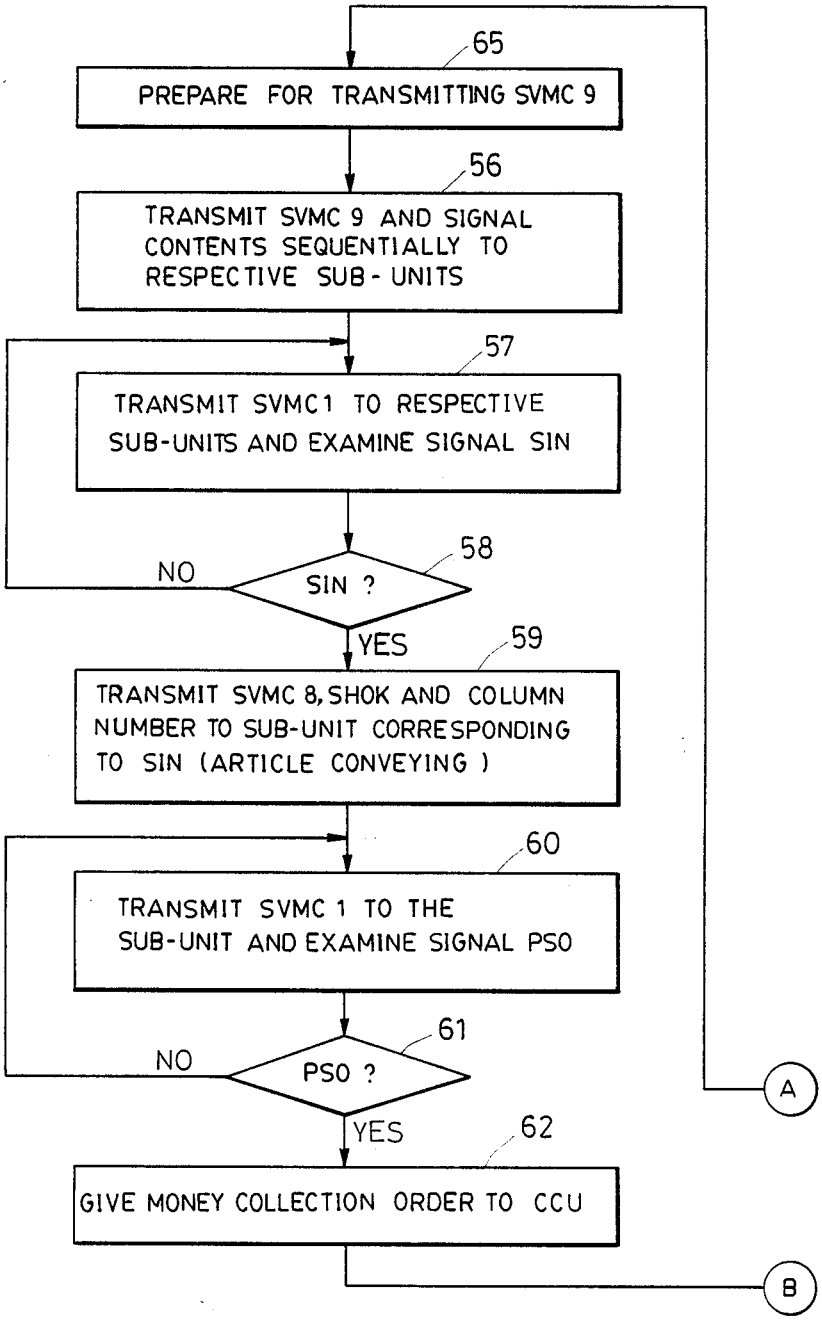
Figure 6:
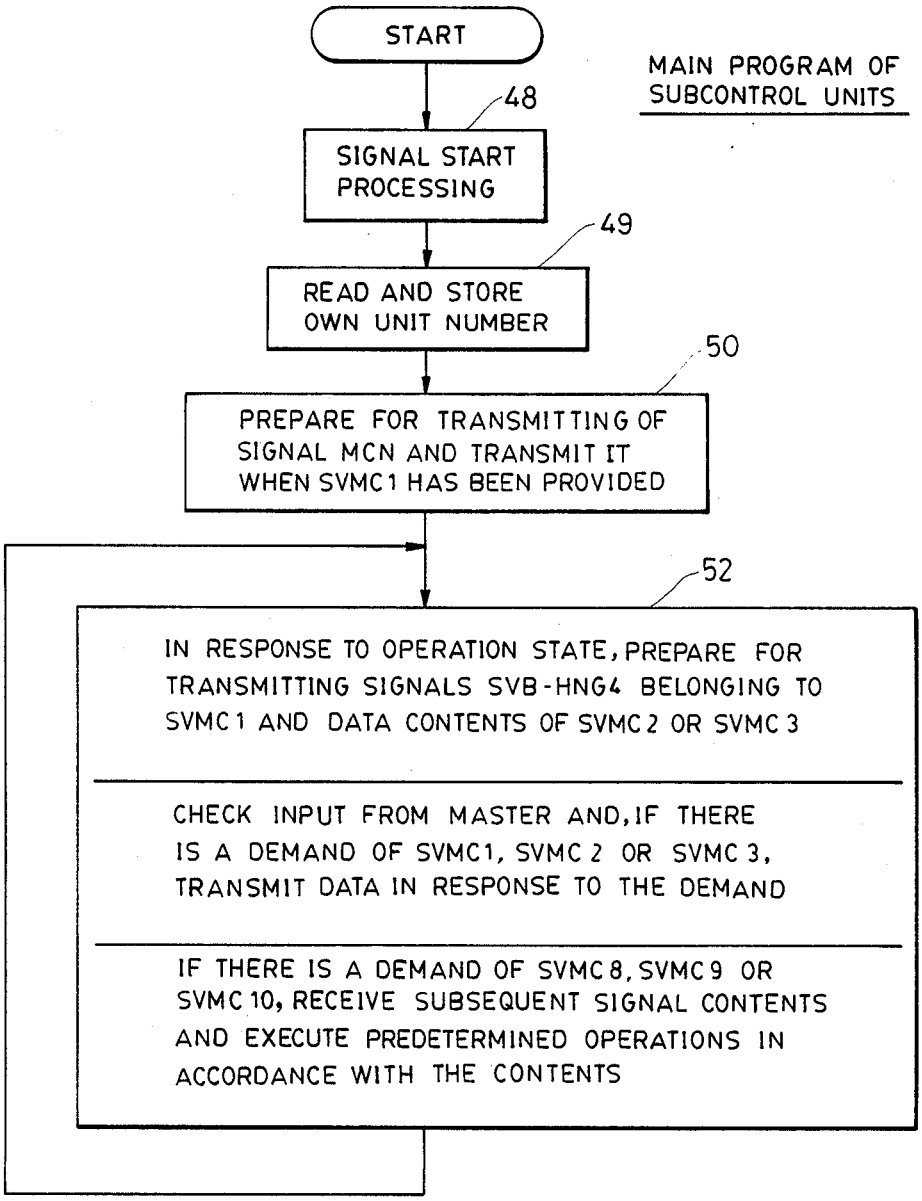
FIG. 6 is a flow chart showing schematically an example of a main program executed in the subcontrol units of the same embodiment.

Referring to FIGS. 5 and 6 when necessary, the outline of the main programs of the master control unit and subcontrol units will now be described.

In both main programs, a signal start processing (steps 47, 48) is executed upon turning on of power. The signal start processing is a processing in which pace-matching (synchronizing) of states of input and output signals at the I/O ports of the master control unit MCU and the subcontrol units $SCU_1$–$SCU_n$ is made to set the I/O port conditions in the respective control units (particularly the C port signal conditions as shown in Tables 9 and 10) at a standby state (i.e., start state). Though not particularly shown, if an error has occurred in the course of transmission and receiving of a signal (i.e., abnormality has occurred in the C port signal condition as was previously described), a similar signal start processing is executed as required.

Then, the subcontrol unit executes a processing of step 49, reading and storing data of its unit number. A switch for setting the unit number (not shown) is provided in each of the slave vendors $7_1$–$7_n$ and the operator sets a unit number proper to each of the slave vendors $7_1$–$7_n$ by operating this switch. In step 49, the unit number thus set is read by the subcontrol units $SCU_1$–$SCU_n$ and stored in their inside memories Thereafter, upon receiving inquiry about the unit number from the master control unit side, the subcontrol units $SCU_1$–$SCU_n$ refer to the number stored here as their number. Alternatively, the number set by the switch may be directly referred to each time the master control unit has made inquiry about the unit number, omitting this step 49.

In step 50 on the subcontrol unit side, the maximum number of columns available for vending in its slave vendor [the number of article stockers) is checked (this also can be preset by setting of a switch or the like means) so as to prepare for transmission of data of three words (see Tables 5 and 6) consisting of the maximum available column number indication signal MCN and data of the maximum number of columns. When the module code SVMC1 (the master control unit indication mode) has been provided upon designating its own unit number in this state, the data of three words including the signal MCN is transmitted to the master control unit.

On the other hand, in step 51 on the master control unit side, the module code SVMC1 is transmitted sequentially for each unit number and receives an answer of three words including the signal MCN from the corresponding subcontrol unit. The answered unit number and its column number are stored and utilized for subsequent processing operations and transmission and receiving control. That is, transmission and receiving of information are performed only with respect to the subcontrol unit which has answered and processings such as the vend possible judgement are performed within the limit of the maximum column number answered.

As will be apparent, the processing of step 51 on the master control unit side and the processing of step 50 on each subcontrol unit side are performed in synchronism. By previously performing such processings of steps 51 and 50, a control in which no inconvenience is caused how many and whatever type of slave vendor ($7_1$–$7_n$) may be connected to a single master vendor can be ensured.

In routine 52 on the subcontrol unit side, the following three processings are generally executed as required. The first one is a processing in which the operation state of its slave vendor is checked and, in response to the operation state, preparation is made for transmitting the signals SVB-HNG4 (see Table 6) belonging to the master control unit indication mode (SVMC1) and its data contents and also preparation is made for transmitting data contents (six words) of the sold-out contents indication mode (SVMC2) or data contents (six words) of the conveying possible column indication mode (SVMC3). The second one is a processing in which input of the module code transmitted from the master control unit side by designating its unit number is checked and, if the module code is either SVMC1, SVMC2 or SVMC3, the data which has been prepared in the above described manner is transmitted. The last one is a processing in which, if the module code inputted by designating its unit number is either SVMC8, SVMC9 or SVMC10, subsequent signal contents are received and predetermined operations such as the vend possible lamp lighting operation and the article conveying operation are executed in accordance with the signal contents.

In step 53 on the master control unit side, transmission and receiving of signals are performed between the master control unit and the coin mechanism control unit CCU for checking the state of the coin mechanism side and the module codes SVMC1–SVMC3 of the receiving mode are provided at a proper timing to the respective subcontrol units for receiving an answer and thereby checking states of the respective subcontrol units. Further, if necessary, a processing in which the module code SVMC10 of the receiving mode and its signal contents or any of the signals of SVMC8 and its data contents are transmitted to the respective subcontrol units or a specific subcontrol unit is performed.

In next step 54, whether or not money has been deposited (whether or not the amount of deposited money or its balance exists) is examined in response to a result of the coin mechanism check. Step 53 is repeated until has been deposited and upon deposition of money, the processing proceeds to step 55.

In step 55, results of vend possible judgement concerning all columns of all slave vendors $7_1$–$7_n$ are received from the coin mechanism control unit CCU to examine whether or not there is a column available for vending. If the answer is YES, preparation is made for transmitting the module code SVMC9 for the vend possible lamp lighting indication mode and signal contents of six words (step 65). In next step 56, the module code SVMC9 and the signal contents of six words thus prepared are sequentially transmitted to the respective subcontrol units. In response thereto, the subcontrol unit side which has received them turns on the vend possible lamp of the column in which vending is possible by executing the processing of step 52. When the article selection operation has been made, preparation is made for transmitting the article selection signal input presence indication signal SIN (see Table 6) and its column number data.

On the master control unit side, the processing proceeds to step 57 after step 56, transmitting sequentially the module code SVMC1 of the master control unit indication mode to the respective subcontrol units. Each time the module code SVMC1 is transmitted to one subcontrol unit, whether or not the article selection signal input presence indication signal SIN has been given in response thereto is examined (step 58). If the answer is NO, the processing returns to step 57 and the transmission of SVM1 is performed with respect to another subcontrol unit.

When the fact that the article has been selected with respect to a certain column in a certain subcontrol unit has been confirmed, the processing proceeds from YES of step 58 to step 59 in which information cf one unit consisting of the unit number, the module code SVMC8, the article conveying indication signal SHOK (see Table 7) and data of two words indicating its column number for the particular subcontrol unit are transmitted. The corresponding subcontrol unit receives this information and thereupon starts the article conveying operation. When the money collection condition has been achieved, preparation is made for transmitting the money collection indication signal PSO (see Table 6) and its column number.

The master control unit proceeds to step 60 after step 59, transmitting the unit number and module code SVMC1 of the corresponding subcontrol unit and examining whether or not the moeny collection indication signal PSO has been produced in response thereto. Upon finding that the money collection indication signal PSO has been produced, the processing proceeds from YES of step 61 to step 62 in which a money collection order is given to the coin mechanism control unit CCU. The coin mechanism control unit subtracts the set vend price of the article sold from the amount of deposited money (i.e., performing money collection). Nextly, in step 63, the coin mechanism control unit CCU examines whether or not there is demand for change payout and, if the answer is YES, commands the coin mechanism control unit CCU to perform the change payout operation by processing in step 64. If the answer is NO, the processing returns to step 53 in which the above described processings are repeated thereby enabling continuous vending.

Description of Modified Examples

The manner of connection between the master control unit MCU and the respective subcontrol units $SCU_1$-$SCU_n$ is not limited to the one shown in FIG. 2 but various modifications as shown in FIGS. 7–15 can be made. In the respective figures, data input ports IN, $IN_s$, $IN_m$ and $IN_c$, data output ports OU, $OU_s$, $OU_m$ and $OU_c$, control signal input ports CI, $CI_s$, $CI_m$ and $CI_c$ and control signal output ports CO, $CO_s$, $CO_m$ and $CO_c$ are the same as those shown in FIG. 2.

Figure 7:
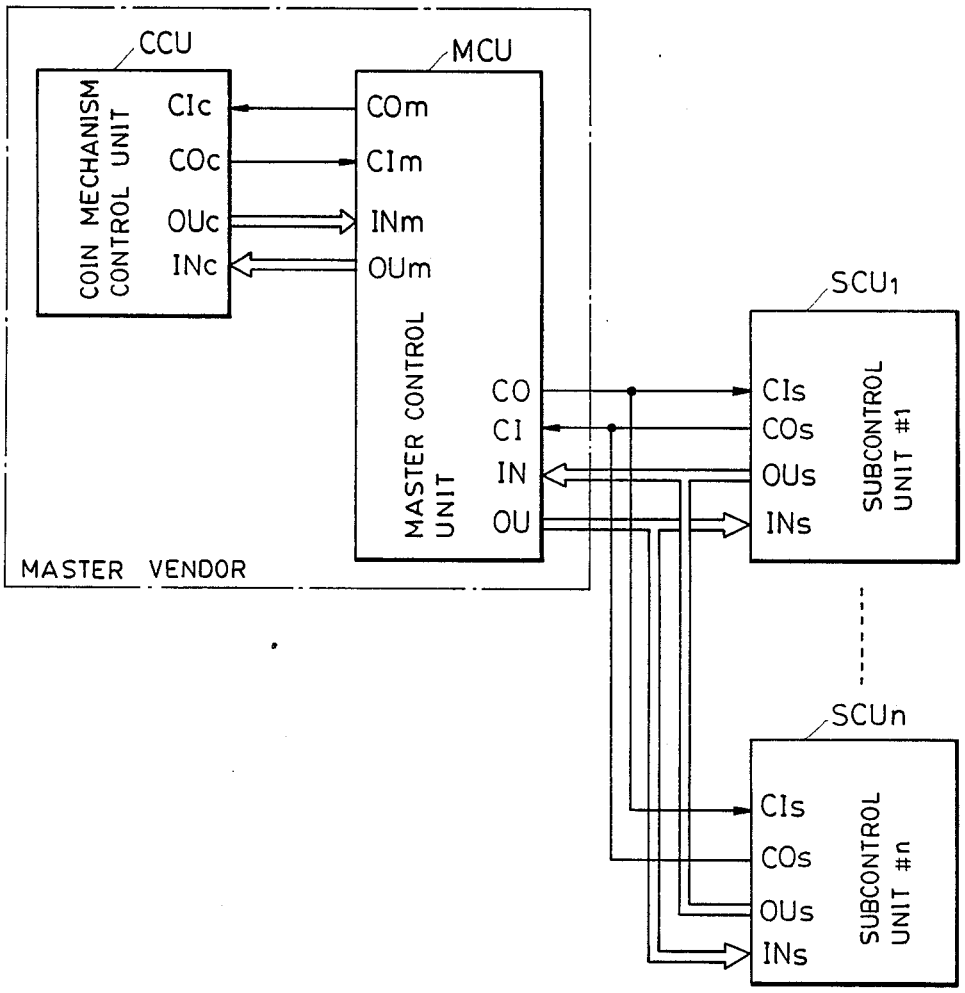
FIGS. 7 through 15 are block diagrams showing respectively modified examples of signal connections in the hardware construction shown in FIG. 2.
Figure 8:
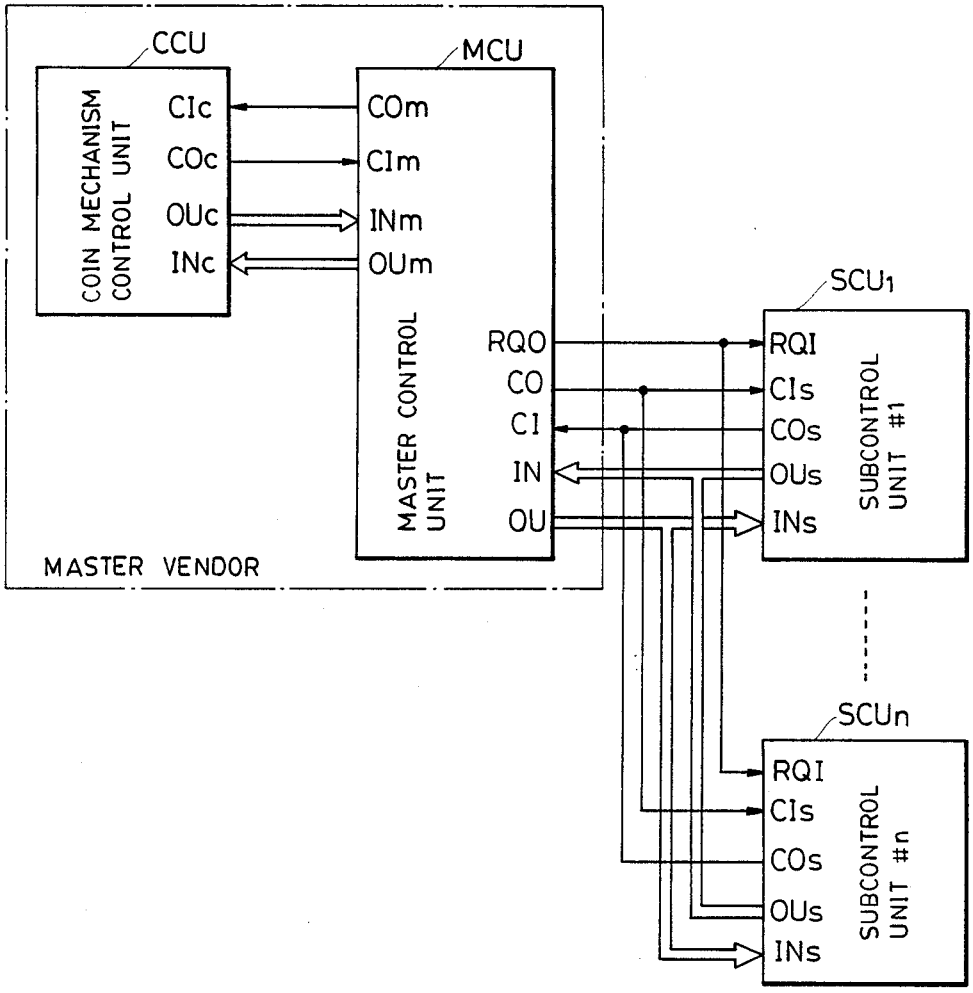
Figure 9:
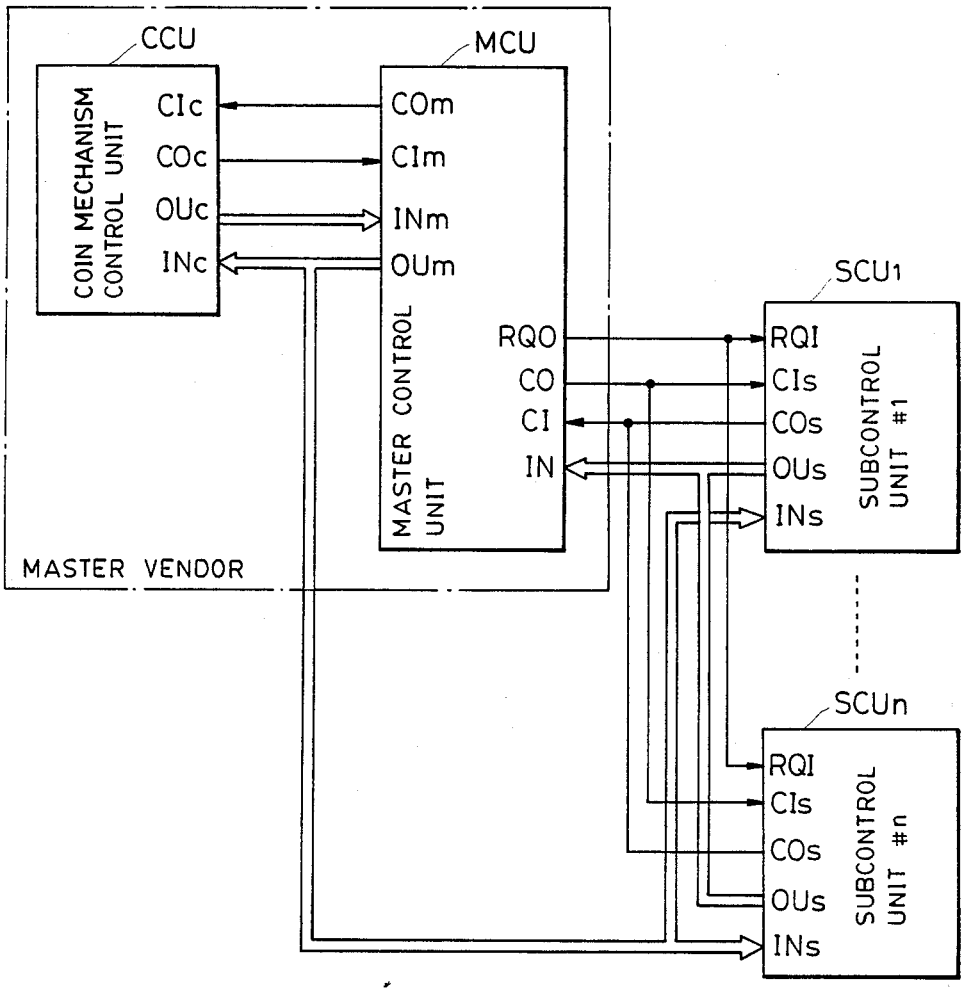
Figure 10:
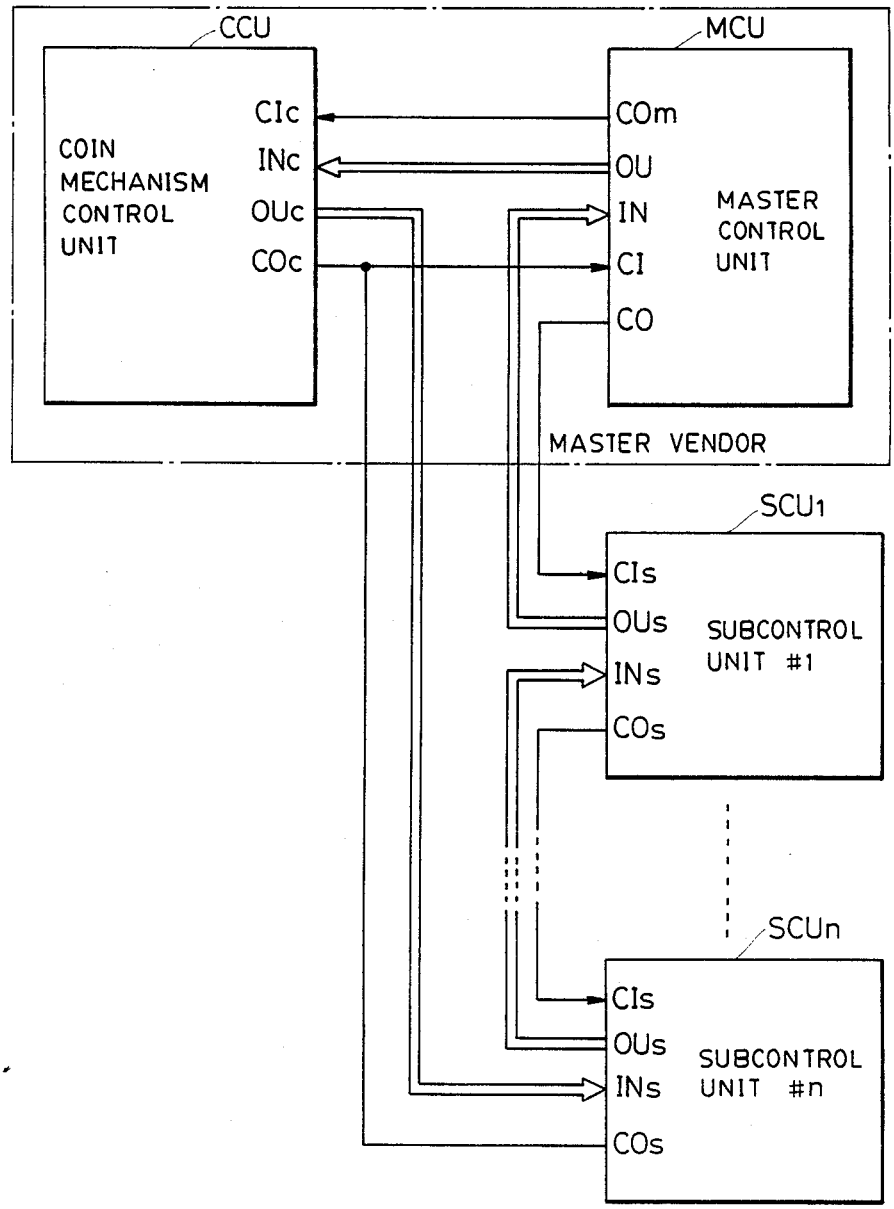
Figure 11:
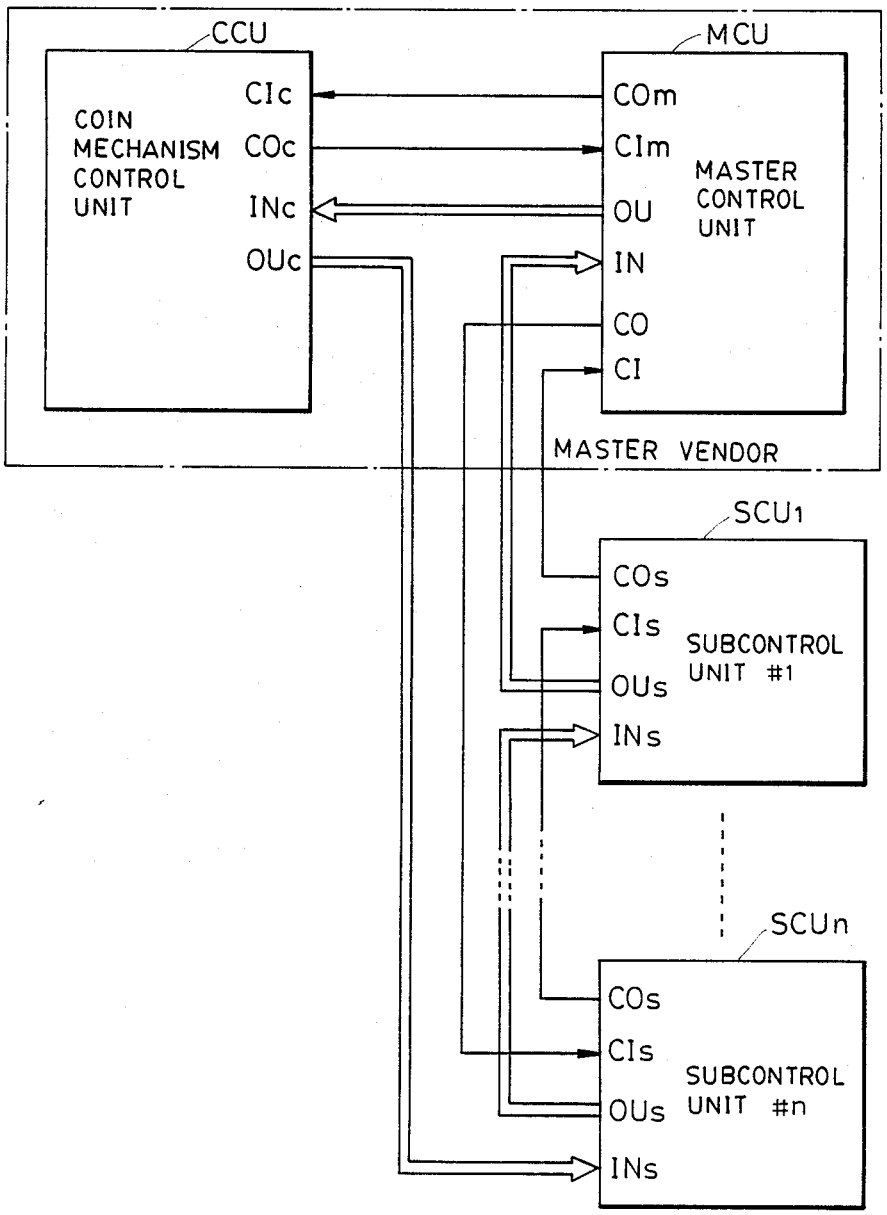
Figure 12:
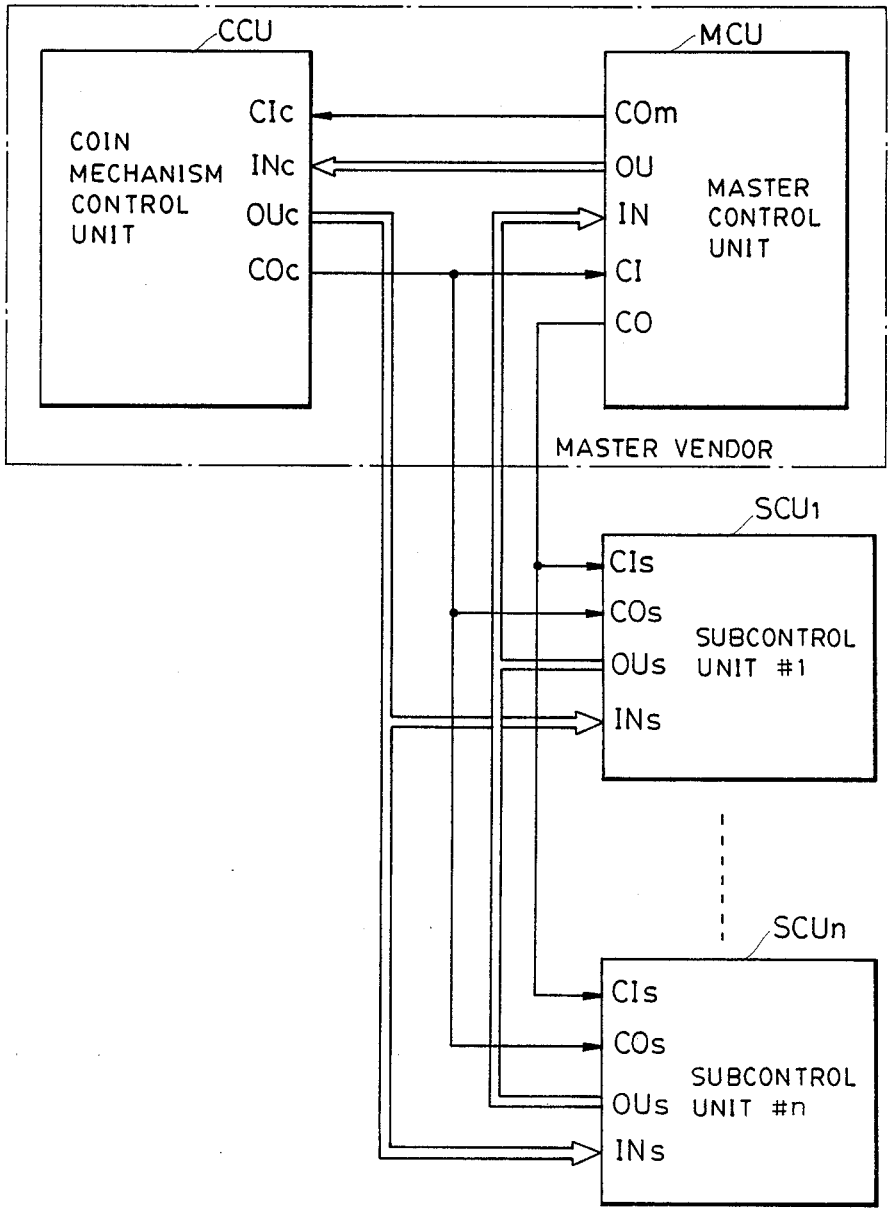

In the examples of FIGS. 7–9, the master control unit MCU comprises, as in the one in FIG. 2, input and output port sections for transmission and receiving with respect to the subcontrol units and input and output port sections for transmission and receiving with respect to the coin mechanism control unit provided separately from each other. In FIG. 7, the input and output ports for the respective subcontrol units are connected in parallel to the input and output ports of the master control unit. In the example of FIG. 8, input and output port connection similar to the one shown in FIG. 7 is adopted but a request signal output port RQO is provided on the master control unit and a request signal input port RQI is provided on the respective subcontrol units, the RQO being connected to the respective RQI in parallel. Description about the request signal will be made later. In the example of FIG. 9, a single data output port $OU_m$ is provided in the master control unit and this $OU_m$ port is connected to the $IN_c$ port of the coin mechanism control unit and the $IN_s$ ports of the respective subcontrol units in parallel. Further, the request signal output port RQO and input port RQI are provided.

Figure 13:
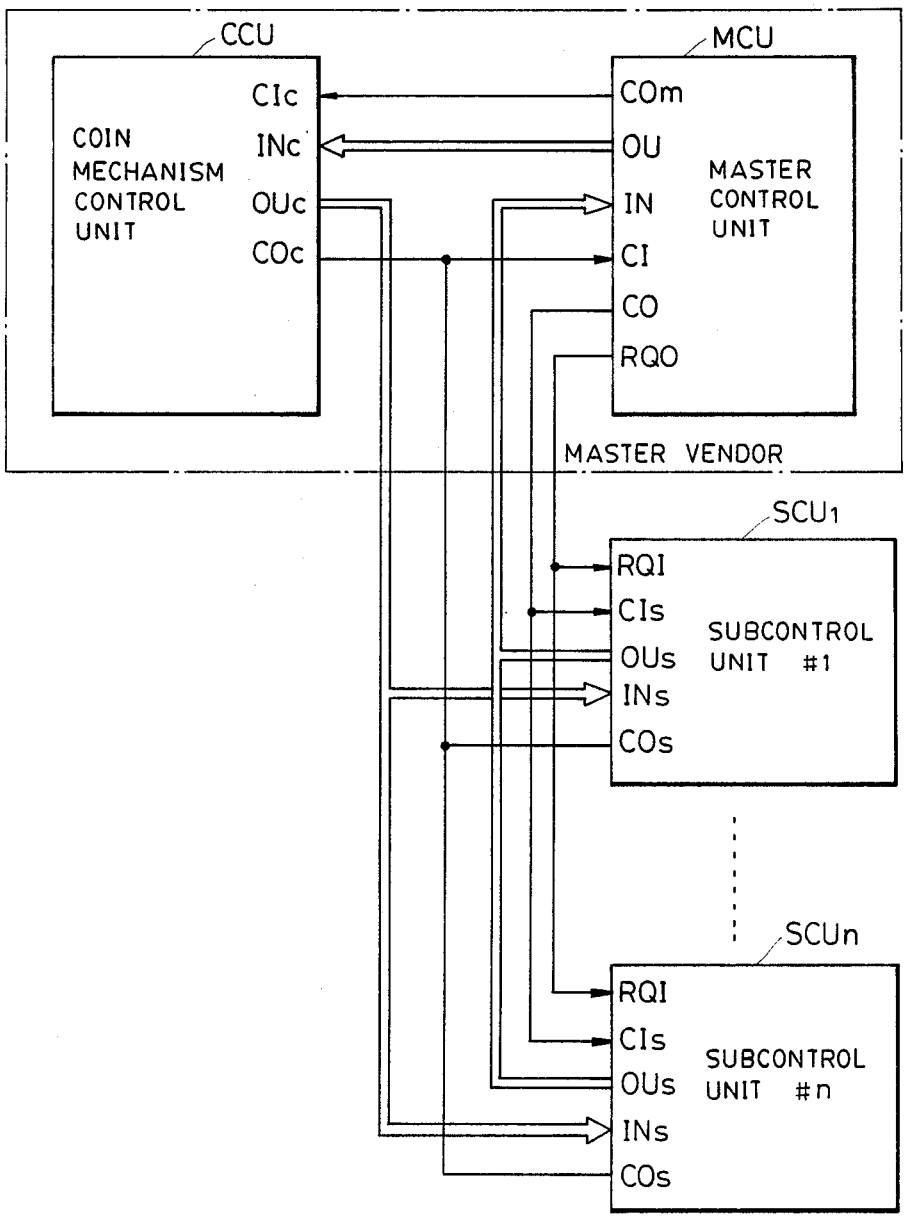
Figure 14:
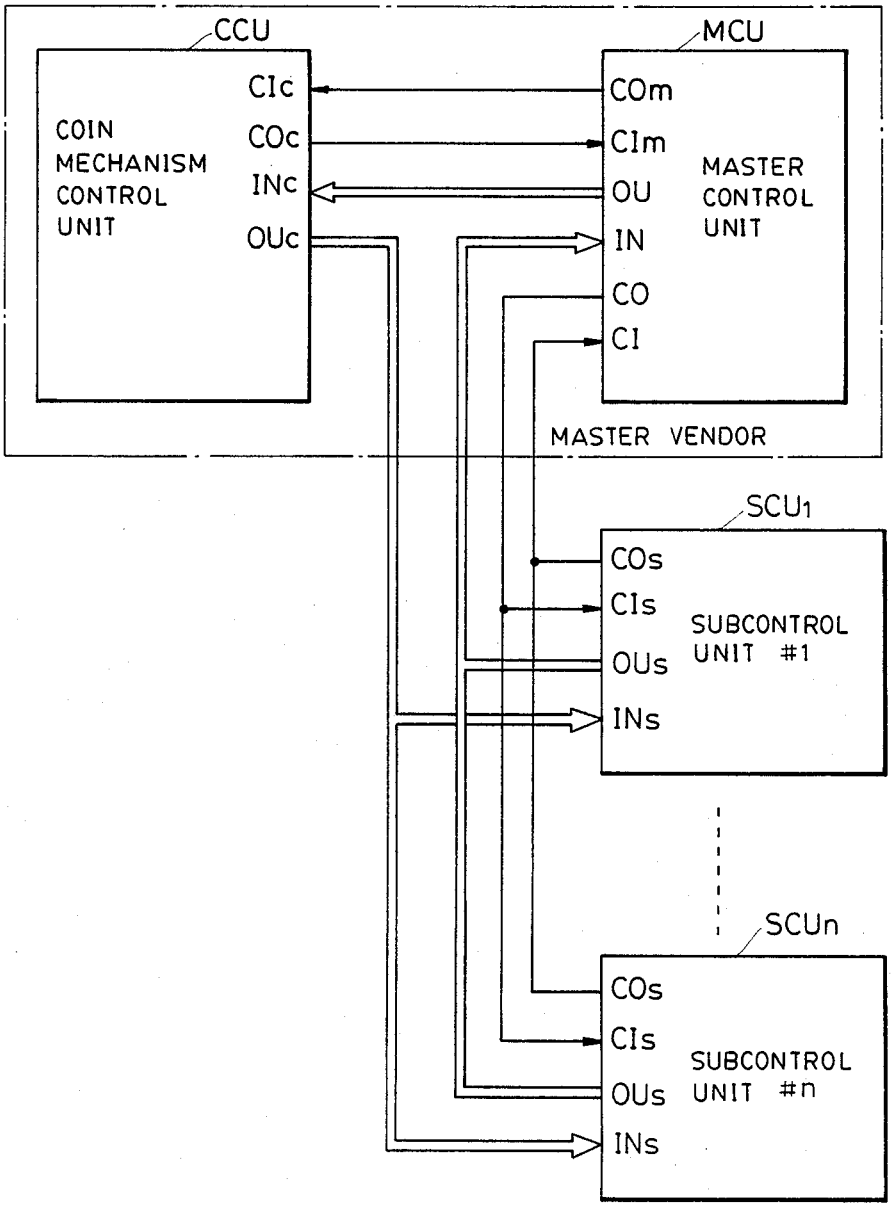
Figure 15:
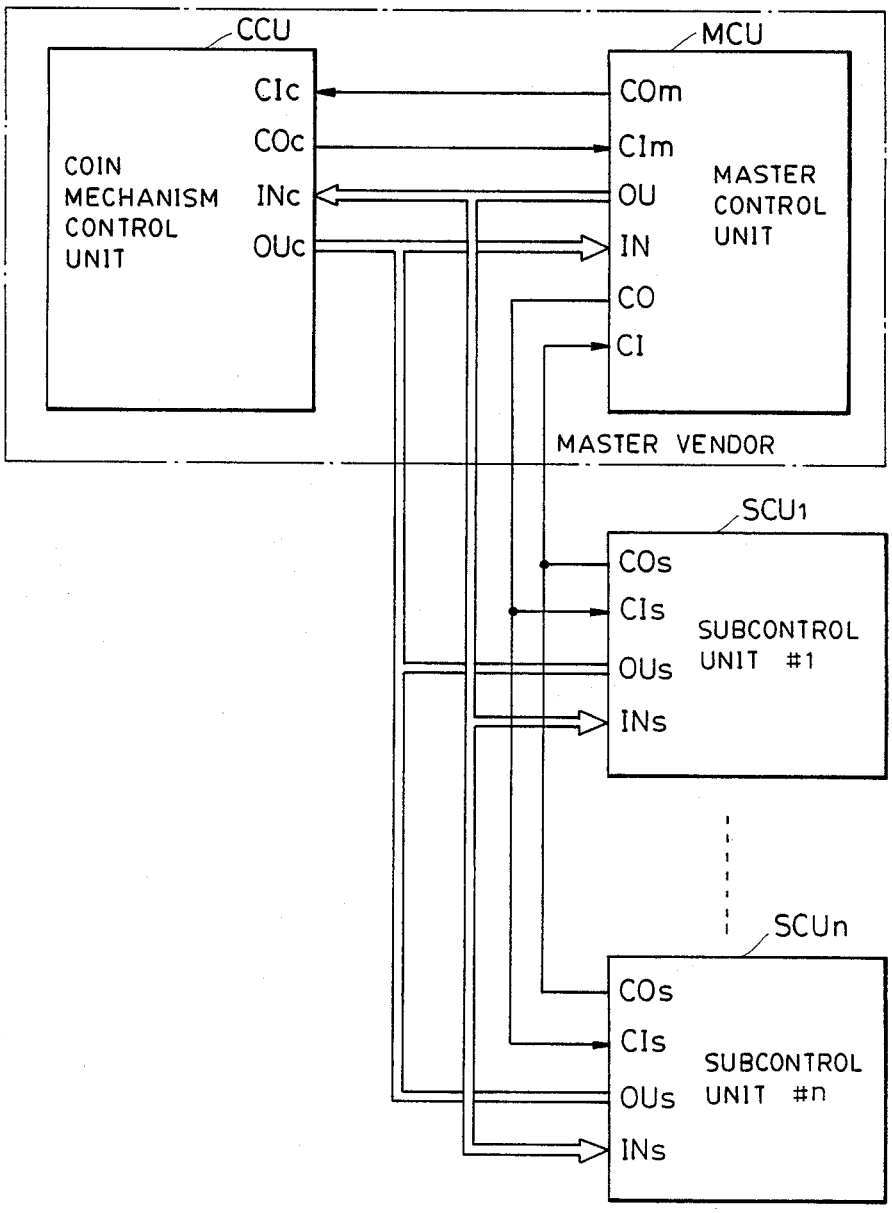

In the examples shown in FIGS. 10–15, the master control unit effects transmission and receiving of signals with respect to the respective subcontrol units and the coin mechanism control unit using common input and output ports. In this case; the unit number is assigned not only to the respective subcontrol units but to the coin mechanism control unit so that the transmission and receiving with respect to the respective subcontrol units and those with respect to the coin mechanism control unit may be distinguished from each other. In the example of FIG. 13, the request signal input and output ports RQI and RQO are also provided.

The signal transmission and receiving in the examples of FIGS. 7–15 are basically the same as those described above in conjunction with the embodiment of FIG. 2, though there are some minor differences in details.

Supplementary explanation will be made about the examples in which the request signal input and output ports RQI and RQO are provided as in those in FIGS. 8, 9 and 13. In these examples, the request signal is employed in addition to the control signal in transmission and receiving of signals between the master control unit and the respective subcontrol units and this request signal is transmitted and received through the input and output ports RQI and RQO. This request signal is used for confirming that the data given from the data output port OU to the input port $IN_s$ is the unit number data in transmission and receiving of the unit number data at the start of transmission and receiving of information of one unit. This request signal is transmitted together with the unit number data from the RQO port when at least the unit number data is transmitted from the OU port of the master control unit. When the request signal has been received through the RQI port, the respective subcontrol units identify that the data given to the $IN_s$ port at this time is the unit number data and judges whether or not this number is its own number.

Figure 16:
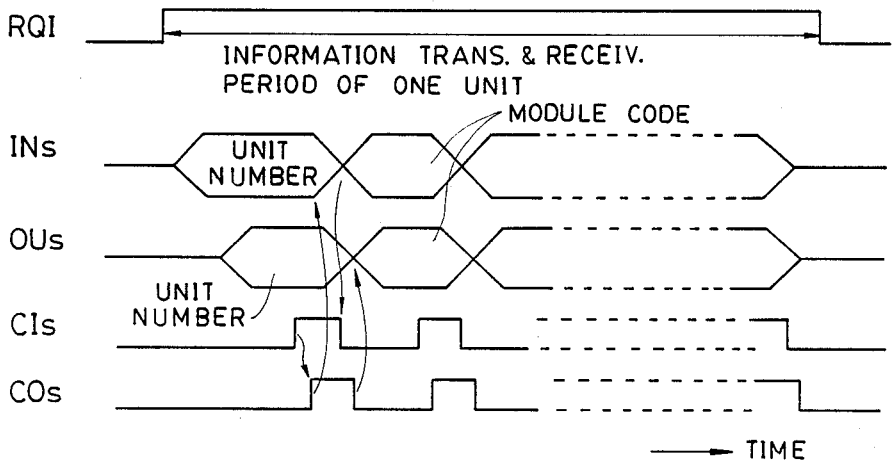

FIG. 16 is a time chart showing an example of signals appearing at the respective input and output ports RQI - $CO_s$ when the subcontrol unit has received the request signal and its unit number. In this example, the request signal is applied to the request signal input port RQI during the entire period in which information of one unit is transmitted and received. As was previously described, the actual signal level is active-low but in the time charts of FIGS. 16–19, the signal level is drawn as if it was active-high for the sake of convenience.

Figure 17:
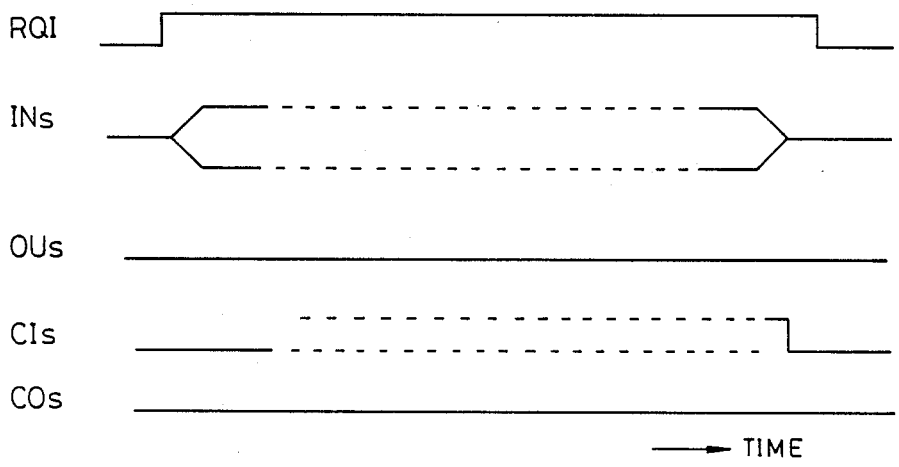

FIG. 17 is a time chart showing an example of signals appearing at the respective input and output ports when the first data received with the request signal by the subcontrol unit is not its unit number.

Figure 18:
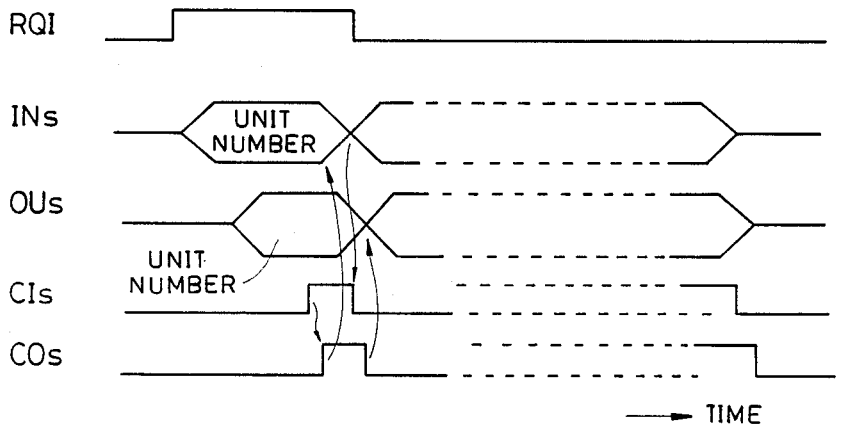

FIG. 18 is a time chart showing an example of signals under the same condition as those in FIG. 16 except that the time length of the request signal at the RQI port is not the entire period of transmission and receiving of information of one unit but a period of time during which the unit number data is transmitted.

Figure 19:
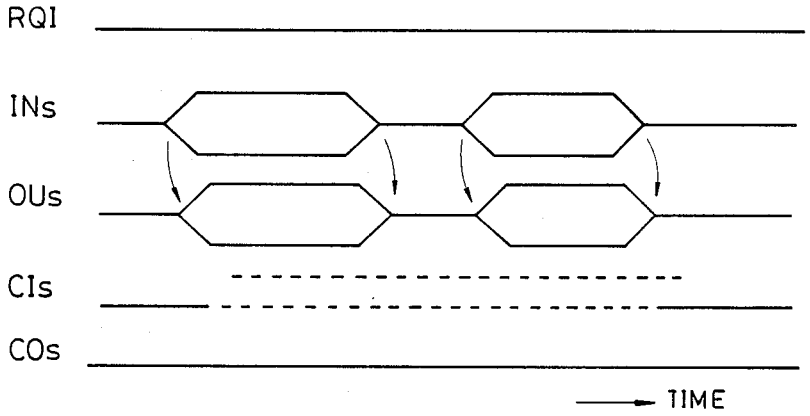

FIG. 19 is a time chart showing an example of signals appearing at the input and output ports of the subcontrol unit when the request signal has not been given. In this case, the signal at the $IN_s$ port is transferred as it is to the $OU_s$ port and delivered out therefrom.

In the above embodiments, description has been made on the assumption that the master vendor has no vending functions such as the article selection and article conveying functions. The scope of the invention is not limited to this but devices such as plural article stockers (columns), article conveying device and article selection switch may be provided in the master vendor.

As will be apparent from the foregoing description, according to the present invention, transmission and receiving of information between a single master vendor and a plurality of slave vendors connected to this master vendor can be controlled properly under the leadership of the master control unit whereby the control can be effected as if these slave vendors were connected independently to the master vendor. Besides, wiring for transmission and receiving of signals can be simplified.

What is claimed is:

1. A vending machine system comprising:

a master vendor including at least a coin mechanism performing receiving and payout of money and means for judging whether vending is possible or not by comparing amount of deposited money with a set vend price and a plurality of slave vendors made separately from said master vendor and including a plurality of article stocker sections for storing a plurality of different articles, article selection means corresponding to the respective article stocker selections and an article conveying device for dispensing an article from the respective article stocker sections, wherein:

said master vendor further comprises a master control unit for controlling the operation of said respective slave vendors, each of said slave vendors has a subcontrol unit supplying necessary information to said master control unit and receiving control information from said master control unit to control the dispensing cf articles from said plurality of article stocker sections in response to said control information, said master control unit includes means for transmitting requests that specific information should be transmitted from a specific one of said subcontrol units to said master control unit, and means for transmitting demands that specific information should be received by a specific one of said subcontrol units from said master control unit, said transmitted requests and demands including the identification of said specific one of said subcontrol units, and said respective indentified subcontrol units transmit and receive the specific information in accordance with the requests and demands of said master control unit; wherein;

said master control unit transmits, when it requests that specific information should be transmitted from the specific subcontrol unit to said master control unit, an identification comprising number data indicating the specific subcontrol unit and a module code representing contents of the request to the respective subcontrol units and transmits, when it demands that the specific subcontrol unit should receive the specific information from said master control unit, an identification comprising number data indicating the specific subcontrol unit and a module code representing contents of the demand to the respective subcontrol units, and each of said subcontrol units decodes the number data provided by said master control unit and, if it indicates the number of the subcontrol unit which has received the number data, complies with the demand represented by the module code, by receiving data representing contents of the information and utilizing the information if the demand indicates the receiving of the information and transmitting data representing contents of the information to said master control unit if the request indicates the transmitting of the information.

2. A vending machine system as defined in claim 1 wherein wiring is provided between said master control unit and said respective subcontrol units and said master control unit provides a request signal through said wiring when said master control unit indicates a specific one of said subcontrol units with which transmission and receiving of information should be performed.

3. A vending system having slave vending units, comprising:

a master vending unit having a money acceptance mechanism, an article storage mechanism, an article conveying mechanism, and a master control unit, said master control unit comprising:

master control means for providing control data including instruction data and unit data identifying slave vending units;

master data output means for receiving said control data from said control means and providing said control data as external data signals;

master data input means for receiving externally provided input data and providing said data to said master control means;

a plurality of slave vending units each having an article storage mechanism comprising a plurality of separate storage sections for storing articles of different types having differing vend prices associated therewith, an article conveying mechanism, and a subcontrol unit for receiving data from said master control unit and transmitting data to said master control unit, said subcontrol unit comprising:

slave data input means for receiving data from said master control unit;

slave data output means for outputting data to said master control unit; and subcontrol means coupled to said data input means and said data output means for controlling a plurality of subcontrol functions including dispersing of said articles in response to said instructor data received from said master control unit and for providing input data to said master control unit in response to said instruction data received from said master control unit wherein:

said master control unit transmits, when it requests that specific information should be transmitted from the specific subcontrol unit to said master control unit, an identification comprising number data indicating the specific subcontrol unit and a module code representing contents of the request to the respective subcontrol units and transmits, when it demands that the specific subcontrol unit should receive the specific information from said master control unit, an identification comprising number data indicating the specific subcontrol unit and a module code representing contents of the demand to the respective subcontrol units, and each of said subcontrol units decodes the number data provided by said master control unit and, if it indicates the number of the subcontrol unit which has received the number data, complies with the demand represented by the module code, receiving data representing contents of the information and utilizing the information if the demand indicates the receiving of the information and transmitting data representing contents of the information to said master control unit if the request indicates the transmitting of the information.

4. A vending system as set out in claim 3, wherein said master control means comprises a microprocessor and a program memory and wherein each of said subcontrol means comprises a separate microprocessor and program memory.

5. A vending system as set out in claim 3, wherein said plurality of slave vending units is connected in series with the first of said series of slave vending units and the last of said series of slave vending units connected to said main vending unit and wherein the data output means from each of the slave vending units, other than the last slave vending unit, is connected to the data input means of the next consecutive slave vending unit.

6. A vending system as set out in claim 3, wherein said control data provided by said master control means further comprises a one-bit control signal for indicating 7. A vending system as set out in claim 3, wherein said master control unit further comprises peripheral memory means for alterably storing data representative of vend prices and other data for control of said slave vending units.

8. A vending system as set out in claim 3, wherein said instruction data comprises a series of module codes of 4-bit parallel data.

9. A vending system as set out in claim 3, wherein said master data output means comprises a master data output port and a master control signal output port, said master data input means comprises a master data input port and a master control signal input port, and wherein in each of said plurality of slave vending units said slave data input means comprises a slave data input port and a slave control signal input port, and said slave data output means comprises a slave data output port and a slave control signal output port.

10. A vending machine system comprising:

a single master vendor including a coin mechanism and a vend possible judgment circuit, and a plurality of slave vendors controlled by said master vendor, each having a plurality of article dispensers, said master vendor having a master control unit for controlling the operation of all of the respective slave vendors, each of said slave vendors having a respective subcontrol unit which performs transmission and receiving of information to and from the master control unit and which controls the article vending operation of the respective slave vendor in response to the information provided from the master control unit, and wherein;

the output of said master control unit is applied to the first subcontrol unit, outputs and inputs of the first and nth subcontrol units are sequentially connected in series, and the output of the nth subcontrol unit is connected to the input of said master control unit, whereby the respective subcontrol units are serially connected to said master control unit; and wherein each of said units comprises means for prohibiting receipt of input data and for outputting the input data instantly for transfer to the sequentially adjacent subcontrol unit, when said number data does not indicate the number of said subcontrol unit.

11. A vending machine system comprising:

a single master vendor including a coin mechanism and a vend possible judgment circuit, and a plurality of slave vendors controlled by said master vendor, each having a plurality of article dispensers, said master vendor having a master control unit for controlling the operation of all the respective slave vendors, each of said slave vendors having a respective subcontrol unit which performs transmission and receiving of information to and from the master control unit and which controls the article vending operation of the respective slave vendor in response to the information provided from the master control unit, and wherein;

said master control unit executes a pre-vend processing step in which said master control unit sequentially makes inquiry to the subcontrol units as to the maximum number of available article storing sections and one or more of said subcontrol units provide an answer to such inquiry, and after such pre-vend processing step, said master control unit transmits and receives information only between the subcontrol units which have provided an answer and performs vend possible judgment processing with respect to the corresponding slave vendors based on the maximum number of article storing sections indicated in the answer.

12. A vending machine system as set out in claim 11 wherein said inquiry includes a module code signal transmitted sequentially to each subcontrol unit and said answer is a three word signal including a maximum available column indication signal.

13. A vending system comprising:

a master vendor, including a coin receiving mechanism and means for judging whether vending is possible or not by comparing the amount of deposited money with a set vend price; and a plurality of slave vendors made separately from said master vendor, each including a plurality of article stocker sections for storing a plurality of articles, article selection means corresponding to the respective article stocker sections and an article conveying device for dispensing an article from the respective article stocker sections, wherein:

said master vendor further comprises a master control unit for controlling the operation of said respective slave vendors, each of said slave vendors has a subcontrol unit supplying necessary information to said master control unit and receiving control information from said master control unit to control the dispensing of articles from said plurality of article stocker sections in response to said control information, said master control unit includes means for transmitting requests that specific information should be transmitted from a specific one of said subcontrol units to said master control unit, and means for transmitting demands that specific information should be received by a specific one of said subcontrol units from said master control unit, said transmitted requests and demands including the identification of said specific one of said subcontrol units, and said respective identified subcontrol units transmit and receive, in compliance with a demand from said master control unit, signals representing the current state of operation of said subcontrol unit, including first and second article conveying signals which represent that an article is being conveyed, the first article conveying signal being used when articles can be dispensed simultaneously in parallel from a plurality of article storing sections in the same slave vendor, and the second article conveying signal being used when articles cannot be dispensed simultaneously in parallel from a plurality of article storing sections in the same slave vendor, and said master control unit judges the function of a certain slave vendor depending upon which type of article conveying signal has been received from said slave vendor and performs a proper control in accordance therewith.

* * * * *